US009743760B1

(12) United States Patent
Vaillancourt

(10) Patent No.: US 9,743,760 B1
(45) Date of Patent: Aug. 29, 2017

(54) FURNITURE PIECE WITH ADJUSTABLE WORKSURFACE

(71) Applicant: Teknion Limited, Toronto (CA)

(72) Inventor: Rémi Vaillancourt, Québec (CA)

(73) Assignee: Teknion Limited, Toronto (CA)

( * ) Notice: Subject to any disclaimer, the term of this patent is extended or adjusted under 35 U.S.C. 154(b) by 0 days.

(21) Appl. No.: 15/049,218

(22) Filed: Feb. 22, 2016

(51) Int. Cl.
*A47F 5/12* (2006.01)
*A47B 27/18* (2006.01)
*A47B 13/08* (2006.01)
*A47B 27/06* (2006.01)

(52) U.S. Cl.
CPC ..... *A47B 27/18* (2013.01); *A47B 13/081* (2013.01); *A47B 27/06* (2013.01)

(58) Field of Classification Search
CPC ..... A47B 27/06; A47B 27/18; A47B 13/081; A47B 19/06; A47B 2200/0043; A47B 2200/0044
USPC ..... 108/6, 9–10, 138, 145
See application file for complete search history.

(56) References Cited

U.S. PATENT DOCUMENTS 1,925,087 A * 9/1933 Andren ..... A47B 27/18 108/2
1,956,546 A * 4/1934 Froelich ..... A47B 27/08 108/136
3,089,275 A * 5/1963 Alabor ..... A47B 27/18 108/145
3,257,975 A * 6/1966 Wiseman ..... A47B 9/00 108/138
3,288,090 A * 11/1966 King ..... D06F 81/04 108/138
3,347,184 A * 10/1967 Kiraly ..... A47B 19/06 108/136
3,444,830 A * 5/1969 Doetsch ..... A47B 27/06 108/136
3,605,650 A * 9/1971 Hebei ..... A47B 85/02 108/13
3,625,160 A * 12/1971 Bergman ..... A47B 27/06 108/2
3,703,147 A * 11/1972 Selander ..... A47B 27/18 108/10
4,196,674 A * 4/1980 Van Laarhoven ..... A47B 27/02 108/4
4,383,486 A * 5/1983 Reineman ..... A47B 9/00 108/10

(Continued)

OTHER PUBLICATIONS

HBF "Costa Multi-purpose Tables", Screenshot Retrieved from the Internet on May 17, 2016, http://www.hbf.com/Products/Pages/Costa-Multi-Purpose-Tables.aspx#.

(Continued)

*Primary Examiner* — Hanh V Tran
(74) *Attorney, Agent, or Firm* — Bereskin & Parr LLP/S.E.N.C.R.L., s.r.l.

(57) ABSTRACT

A furniture piece has a worksurface and a support frame having first and second ends. At least two legs extend downwardly from each of the first and second ends for supporting the furniture piece on a floor surface. A linkage couples the support frame to the worksurface. The linkage is configured so that the worksurface can be moved between a first position in which the worksurface is substantially parallel to a horizontal plane defined by the support frame and a second position in which the worksurface is above and at an angle to the horizontal plane.

21 Claims, 34 Drawing Sheets

(56) References Cited

U.S. PATENT DOCUMENTS

| | | | | |
|---|---|---|---|---|
| 4,726,556 | A * | 2/1988 | Weir | A47B 27/18 248/454 |
| 5,704,299 | A * | 1/1998 | Corpuz, Jr. | A47B 21/0314 108/147 |
| 5,896,817 | A * | 4/1999 | Hancock | A47B 13/081 108/50.01 |
| 6,336,414 | B1 * | 1/2002 | Stewart | A47B 3/0815 108/115 |
| 7,024,710 | B2 * | 4/2006 | Izuhara | A61B 6/04 108/145 |
| 2003/0154890 | A1 * | 8/2003 | Warner | A47B 9/00 108/145 |
| 2007/0266912 | A1 * | 11/2007 | Swain | A47B 9/02 108/145 |
| 2008/0028996 | A1 * | 2/2008 | Ooba | A47B 13/003 108/10 |
| 2009/0095868 | A1 * | 4/2009 | Ohlson | A47B 21/02 248/371 |
| 2010/0127144 | A1 * | 5/2010 | Lange | F16M 11/2014 248/284.1 |
| 2014/0048671 | A1 * | 2/2014 | Tsai | A47B 27/18 248/371 |
| 2015/0289641 | A1 * | 10/2015 | Ergun | A47B 9/16 108/42 |

OTHER PUBLICATIONS

Falcon "Storm ST6T/ST6C Flip Top Tables", Screenshot Retrieved from the Internet on May 17, 2016, https://www.falconproducts.com/products/training-tables/storm-st5-st6c-flip-top-tables.

Bretford "Explore Collaborative Flip & Nest Tables", Screenshot Retrieved from the Internet on May 17, 2016, http://www.bretford.com/product/explore-collaborative-flip-nest-tables.

Ki "Pirouette Table", Screenshot Retrieved from the Internet on May 17, 2016, http://www.ki.com/products/name/pirouette-table/.

Ki "Flurry Up! Table", Screenshot Retrieved from the Internet on May 17, 2016, http://www.ki.com/products/name/hurry-up-table/.

Steelcase "Flip Top Twin", Screenshot Retrieved from the Internet on May 17, 2016, https://www.steelcase.com/eu-en/products/meeting-tables/fliptop-twin/#features__speed-up-configurations.

Coalesse "Train Table", Screenshot Retrieved from the Internet on May 17, 2016, http://www.coalesse.com/products/tables-and-desks/meeting-conference-tables/train-table/.

Coalesse "Ballet Table", Screenshot Retrieved from the Internet on May 17, 2016, http://www.coalesse.com/products/tables-and-desks/meeting-conference-tables/ballet-table/.

Herman Miller "Everywhere Flip-Top Table", Screenshot Retrieved from the Internet on May 17, 2016, http://store.hermanmiller.com/Products/Everywhere-Flip-Top-Table.

Versteel "Paces", Screenshot Retrieved from the Internet on May 17, 2016, http://www.versteel.com/products/tables/paces.

Versteel "TOD", Screenshot Retrieved from the Internet on May 17, 2016, http://www.versteel.com/products/tables/tod.

Mayline "SYNC—Rectangular", Screenshot Retrieved from the Internet on May 17, 2016, https://www.mayline.com/product-detail.php?id=P0714.

Bretford "Explore Flip and Nest Collaborative Table" Brochure Retrieved from the Internet on May 17, 2016, http://www.bretford.com/product/explore-collaborative-flip-nest-tables.

Falcon "Storm Tables" Brochure Retrieved from the Internet on May 17, 2016, https://www.falconproducts.com/products/training-tables/storm-st5-st6c-flip-top-tables.

Coalesse "Ballet Table" Brochure Retrieved from the Internet on May 17, 2016, http://www.coalesse.com/products/tables-and-desks/meeting-conference-tables/ballet-table/.

Coalesse "Train Table" Brochure Retrieved from the Internet on May 17, 2016, http://www.coalesse.com/products/tables-and-desks/meeting-conference-tables/train-table/.

HBF "The Costa Series" Brochure Retrieved from the Internet on May 17, 2016, http://www.hbf.com/Products/Pages/Costa-Multi-Purpose-Tables.aspx#.

Herman Miller "Everywhere Tables" Brochure Retrieved from the Internet on May 17, 2016, http://store.hermanmiller.com/Products/Everywhere-Flip-Top-Table.

Ki "Hurry Up! Tables" Brochure Retrieved from the Internet on May 17, 2016, http://www.ki.com/products/name/hurry-up-table/.

Ki "Pirouette Table" Brochure Retrieved from the Internet on May 17, 2016, http://www.ki.com/products/name/pirouette-table/.

Mayline "Meeting & Training Solutions" Brochure, SYNC, pp. 4-5, Retrieved from the Internet on May 17, 2016, https://www.mayline.com/product-detail.php?id=P0714.

Steelcase "FlipTop Twin Conferencing" Brochure Retrieved from the Internet on May 17, 2016, https://www.steelcase.com/eu-en/products/meeting-tables/fliptop-twin/#features__speed-up-configurations.

Versteel "Paces" Brochure Retrieved from the Internet on May 17, 2016, http://www.versteel.com/products/tables/paces.

Versteel "TOD" Brochure Retrieved from the Internet on May 17, 2016, http://www.versteel.com/products/tables/tod.

* cited by examiner

FURNITURE PIECE WITH ADJUSTABLE WORKSURFACE

FIELD

This disclosure relates generally to an adjustable furniture piece, and more specifically to a table with an adjustable worksurface.

INTRODUCTION

Tables with adjustable worksurfaces are well known. Such systems are commonly used, for example, in office buildings or in home offices.

Typically, the worksurface is adjusted by pivoting it about a longitudinal axis such that, in the pivoted position, a portion of the worksurface is positioned above the axis of rotation, and a portion of the worksurface is positioned below the axis of rotation. Such a configuration may reduce the vertical displacement of the center of mass of the worksurface during adjustment.

Also, it is common for tables with adjustable worksurfaces to have central support legs, or to have two or more legs whose upper ends are positioned below the central portion of the table. While such a configuration may facilitate the pivoting arrangement discussed above, it may also frustrate and/or prevent a user from being able to sit in a chair at the end of such a table, as the central leg(s) may interfere with the chair and/or the legs of the user.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with a broad aspect, there is provided a furniture piece comprising: a worksurface; a longitudinal frame member; a pair of end frame mechanisms positioned at opposing ends of the longitudinal frame member, each end frame mechanism comprising: a lower end frame member secured to the longitudinal frame member, an upper end frame member secured to a lower surface of the worksurface, and a linkage coupling the upper and lower end frame members, the linkage being configured to permit movement of the upper end frame member relative to the lower end frame member; and at least two legs extending downwardly from each lower end frame member for supporting the furniture piece; wherein upper surfaces of the lower end frame members define a substantially horizontal plane, and wherein the worksurface is configured to move between a first position wherein an upper surface of the worksurface is substantially horizontal and a second inclined position wherein the upper surface of the worksurface is located at an angle to the substantially horizontal plane, and wherein, in the second position, the entire worksurface is located above the substantially horizontal plane.

In some embodiments, the linkage comprises, at each end frame mechanism, a first arm rotationally coupled to both the upper and lower end frame member, and a second arm rotationally coupled to both the upper and lower end frame member.

In some embodiments, the first arm is longer than the second arm.

In some embodiments, the furniture piece further comprises a longitudinal support member extending between the first arms of the pair of end frame mechanisms.

In some embodiments, the linkage further comprises, at each end frame mechanism, a biasing member rotationally coupled to both the upper and lower end frame members, the biasing member being configured to extend and urge the worksurface towards the second position.

In some embodiments, the biasing member comprises a gas piston.

In some embodiments, in the second position, the angle between the upper surface of the worksurface and the substantially horizontal plane is greater than 45 degrees.

In some embodiments, in the second position, the angle between the upper surface of the worksurface and the substantially horizontal plane is about 70 degrees.

In some embodiments, the at least two legs extend downwardly from opposing ends of each lower end frame member.

In some embodiments, the entire upper surface of the worksurface remains above the substantially horizontal plane as the worksurface is moved between the first position and the second position.

In some embodiments, at least one of the end frame mechanisms further comprises a latching system for restraining the worksurface in the first position, the latching system comprising: a latching bar positioned in a latching bar recess of the upper end frame member, the latching bar having at least one latching protrusion that projects from a lower surface of the upper end frame member; and at least one latching recess provided in an upper surface of the lower end frame member, wherein, when the worksurface is in the first position, the at least one latching protrusion is received in the at least one latching recess; wherein the latching bar is configured to move within the latching bar recess between: a latched position in which, when the worksurface is in the first position, the at least one latching protrusion and the at least one latching recess cooperatively retain the worksurface in the first position, and an unlatched position.

In some embodiments, at least one of the end frame mechanisms further comprises a lockout system for restraining the worksurface in the second position, the lockout system comprising: a lockout arm having a first end pivotally coupled to a central portion of the first arm and a second end having a guide protrusion; and a lockout arm guide positioned in the upper end frame member, the lockout arm guide defining a path for the guide protrusion between a first path end and a second path end, the second path end being configured such that the guide protrusion may be releasably retained at the second path end; wherein, when the worksurface is in the second position and the guide protrusion is retained at the second path end, the lockout arm prevents the first arm from rotating relative to the upper end frame member.

In some embodiments, the furniture piece further comprises a release bar configured to move the latching bar from the latched position to the unlatched position, and configured to release the guide protrusion from the second path end.

In accordance with another broad aspect, there is provided a furniture piece comprising: a worksurface; a support frame having a first end, a second end, and an upper surface, the upper surface defining a horizontal plane; a linkage for coupling the support frame to the worksurface; wherein the linkage is configured to permit movement of the worksurface between a first position wherein the worksurface is substantially parallel to the horizontal plane and a second position wherein the worksurface is located at an angle to the horizontal plane; and a first pair of legs extending downwardly from the first end of the support frame and a second pair of legs extending downwardly from the second end of the support frame, wherein upper ends of the legs in each of the first and second pair of legs are spaced apart from each other by at least 300 mm.

In some embodiments, the linkage comprises a first arm rotationally coupled to both the support frame and the worksurface, and a second arm rotationally coupled to both the both the support frame and the worksurface.

In some embodiments, the first arm is longer than the second arm.

In some embodiments, the linkage comprises two linkages, and further comprising a longitudinal support member that extends between the first arms of the linkage.

In some embodiments, the linkage further comprises a biasing member rotationally coupled to both the support frame and the worksurface, the biasing member being configured to extend and urge the worksurface towards the second position.

In some embodiments, the biasing member comprises a gas piston.

In some embodiments, in the second position, the angle between the worksurface and the horizontal plane is greater than 45 degrees.

In some embodiments, in the second position, the worksurface is entirely above the horizontal plane.

In some embodiments, the entire worksurface remains above the horizontal plane as the worksurface is moved between the first position and the second position.

In some embodiments, the upper ends of the legs in each of the first and second pair of legs are spaced apart from each other by at least 400 mm.

In some embodiments, the linkage further comprises a lockout system for restraining the worksurface in the second position, the lockout system comprising: a lockout arm having a first end pivotally coupled to a central portion of the first arm and a second end having a guide protrusion; and a lockout arm guide positioned in an upper end frame member secured to the worksurface, the lockout arm guide defining a path for the guide protrusion between a first path end and a second path end, the second path end being configured such that the guide protrusion may be releasably retained at the second path end; wherein, when the worksurface is in the second position and the guide protrusion is retained at the second path end, the lockout arm prevents the first arm from rotating relative to the upper end frame member.

In some embodiments, the furniture piece further comprises a latching system for restraining the worksurface in the first position, the latching system comprising: a latching bar positioned in a latching bar recess of the upper end frame member, the latching bar having at least one latching protrusion that projects from a lower surface of the upper end frame member; and at least one latching recess provided in an upper surface of a lower end frame member, wherein, when the worksurface is in the first position, the at least one latching protrusion is received in the at least one latching recess; wherein the latching bar is configured to move within the latching bar recess between: a latched position in which, when the worksurface is in the first position, the at least one latching protrusion and the at least one latching recess cooperatively retain the worksurface in the first position, and an unlatched position.

In some embodiments, the furniture piece further comprises a release bar configured to move the latching bar from the latched position to the unlatched position, and configured to release the guide protrusion from the second path end.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
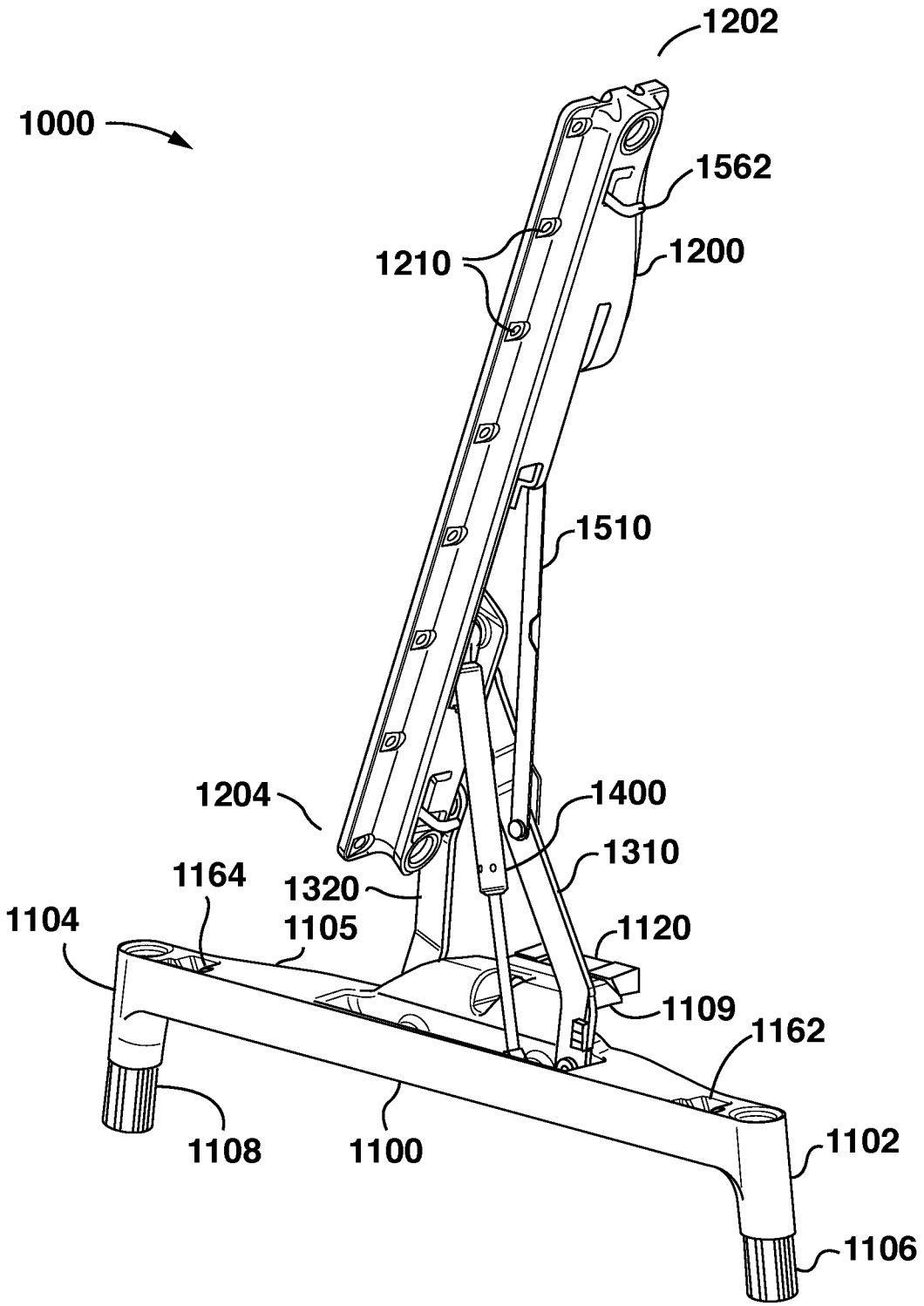
FIG. 1 is a perspective view of an apparatus for use in a furniture piece having an adjustable worksurface according to one embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

While the apparatus and methods disclosed herein are described specifically in relation to a worksurface having a rectangular shape, it will be appreciated that the apparatus and methods may alternatively be used with worksurfaces having any other shape.

Figure 2:
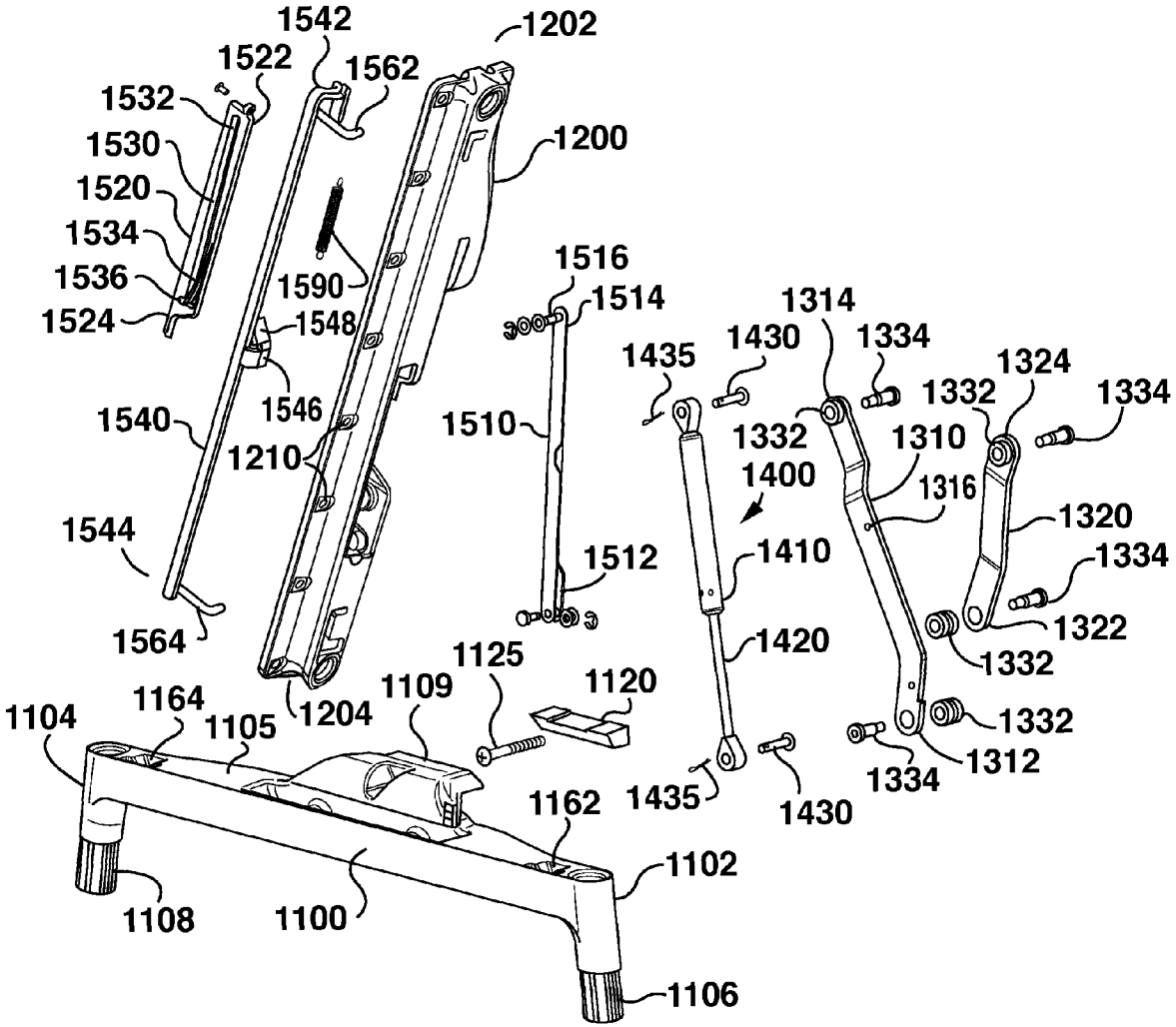
FIG. 2 is an exploded view of the apparatus of FIG. 1.
Figure 12A:
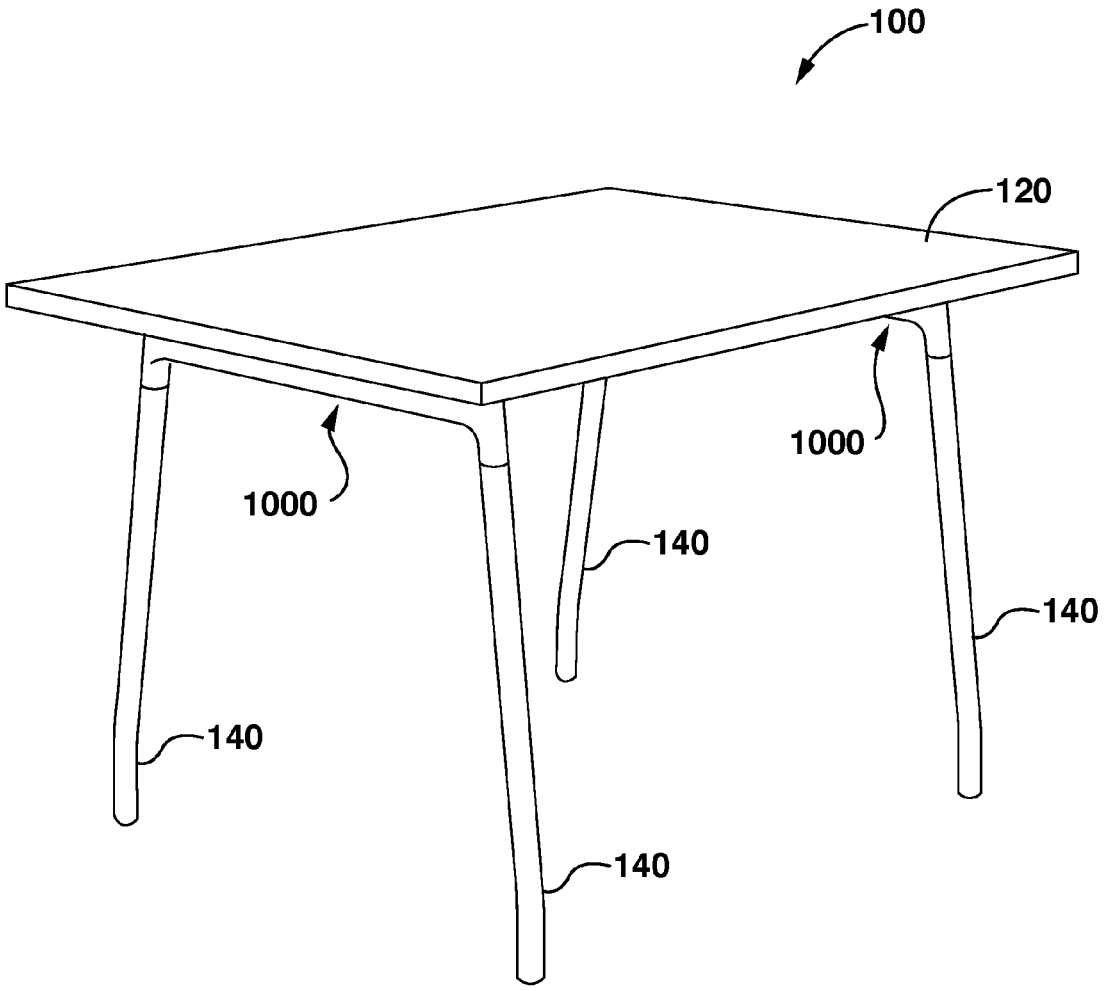
FIGS. 12A-H are a series of perspective views illustrating the worksurface of a furniture piece being adjusted from the level position of FIG. 12A to the inclined position of FIG. 12H.
Figure 12B:
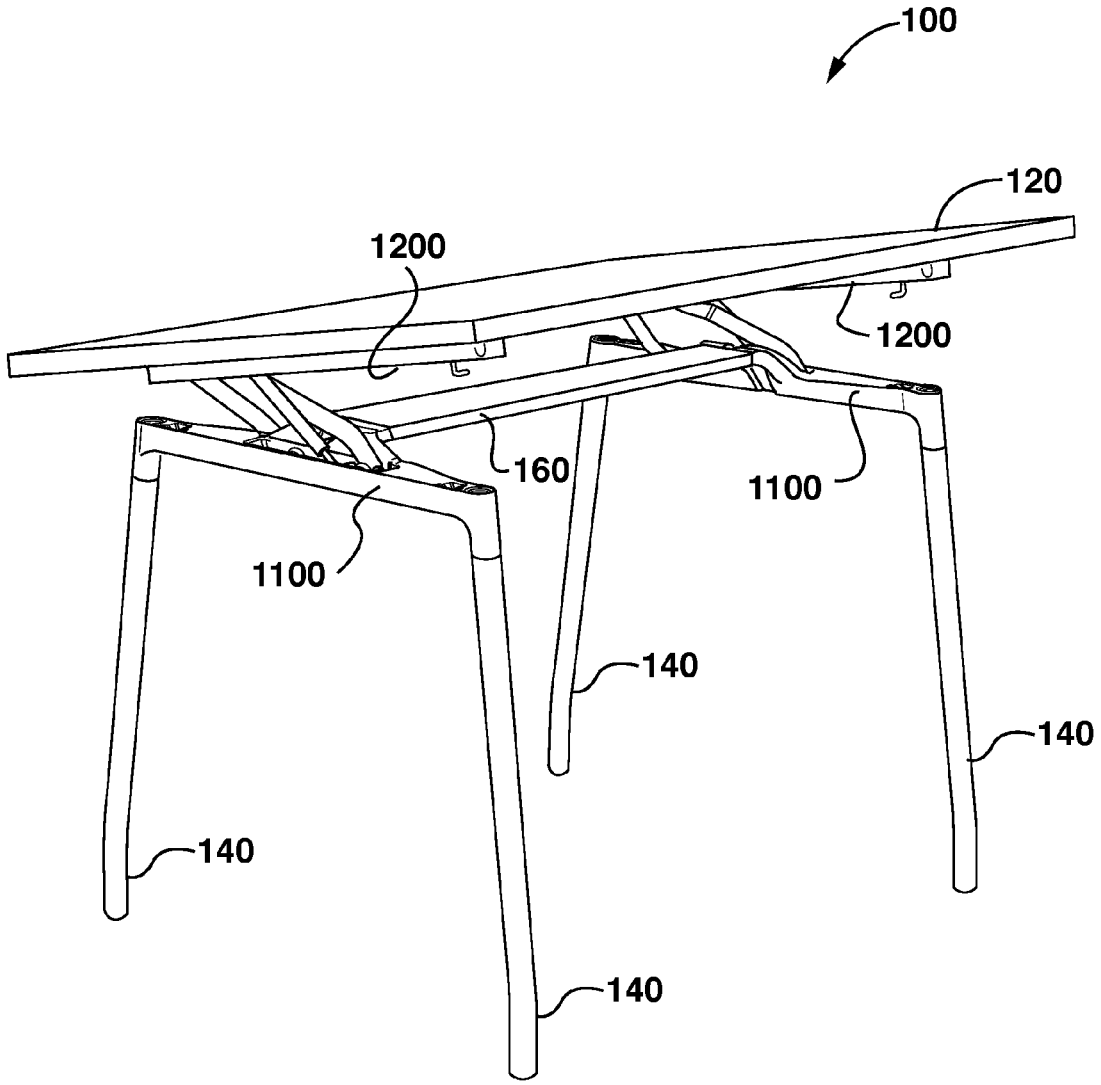
Figure 12C:
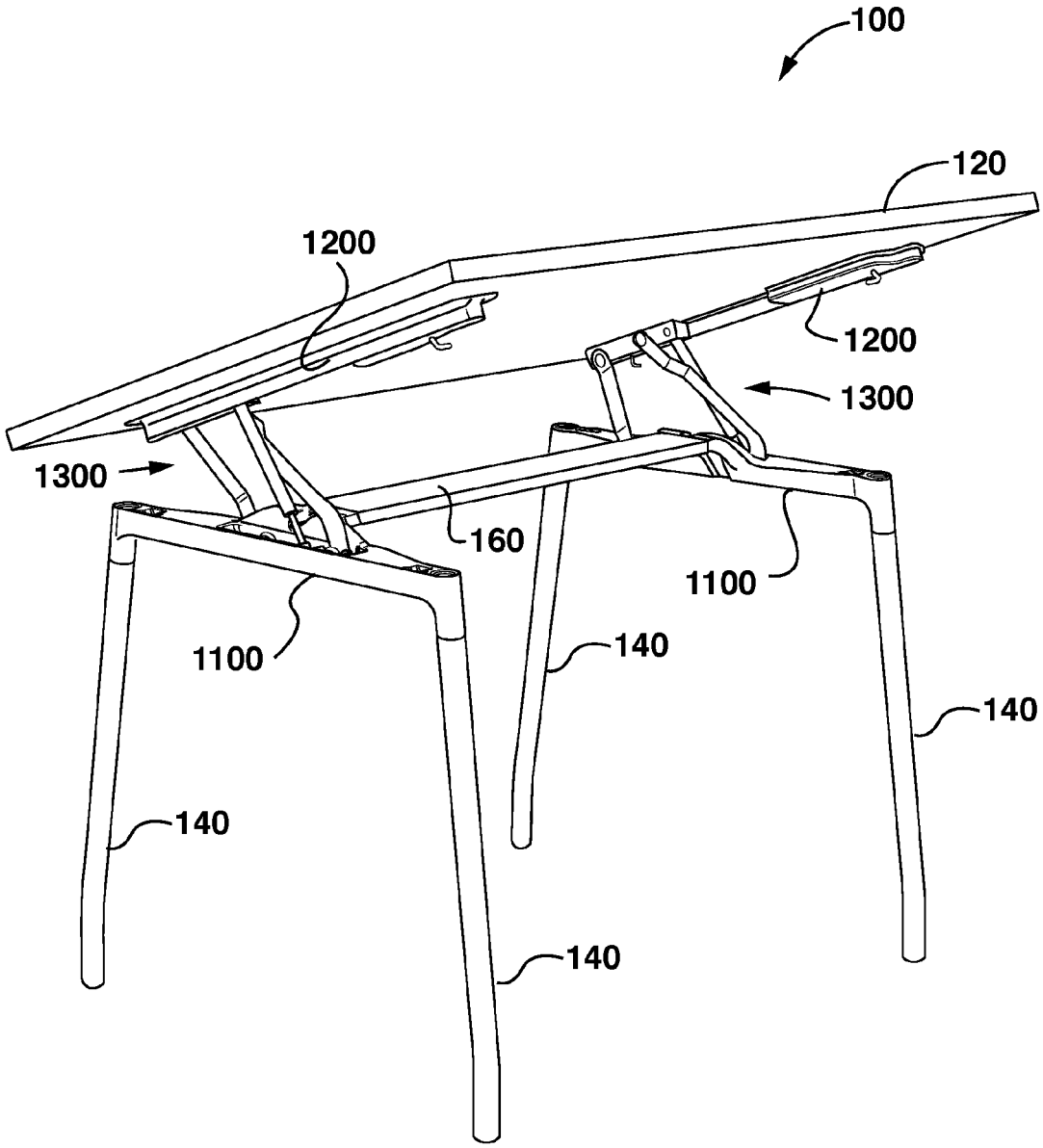

FIGS. 1 and 2 illustrate an apparatus 1000 for use in a furniture piece having an adjustable worksurface. Apparatus 1000 may also be referred to as a 'flip-top' mechanism 1000, or an end frame mechanism 1000. End frame mechanism 1000 includes: a lower end frame member 1100, which, when assembled with a frame member and a plurality of legs (see e.g. frame member 160 and legs 140 in FIG. 12E), forms the base of the furniture piece; an upper end frame member 1200, which supports the worksurface; and a linkage, shown generally as 1300, which connects the upper and lower end frame members and allows the position of the worksurface to be adjusted relative to the base of the furniture piece.

Lower end frame member 1100 has a first end 1102, a second end 1104, and first and second downwardly extending projections 1106, 1108, for mounting a pair of table legs to the lower end frame member. In the illustrated embodiment, each projection 1106, 1108 is inserted into a hollow portion at the upper end of a table leg. Projections 1106, 1108 may be secured to the table legs using any suitable coupling method. For example the projections 1106, 1108 may be threaded or otherwise configured to be mechanically coupled to a table leg (e.g. using a screw and a threaded insert in a table leg, using a set screw or other mechanical fastener, etc.). Optionally, a suitable adhesive may be used to secure projections 1106, 1108 to its respective table leg.

Figure 5:
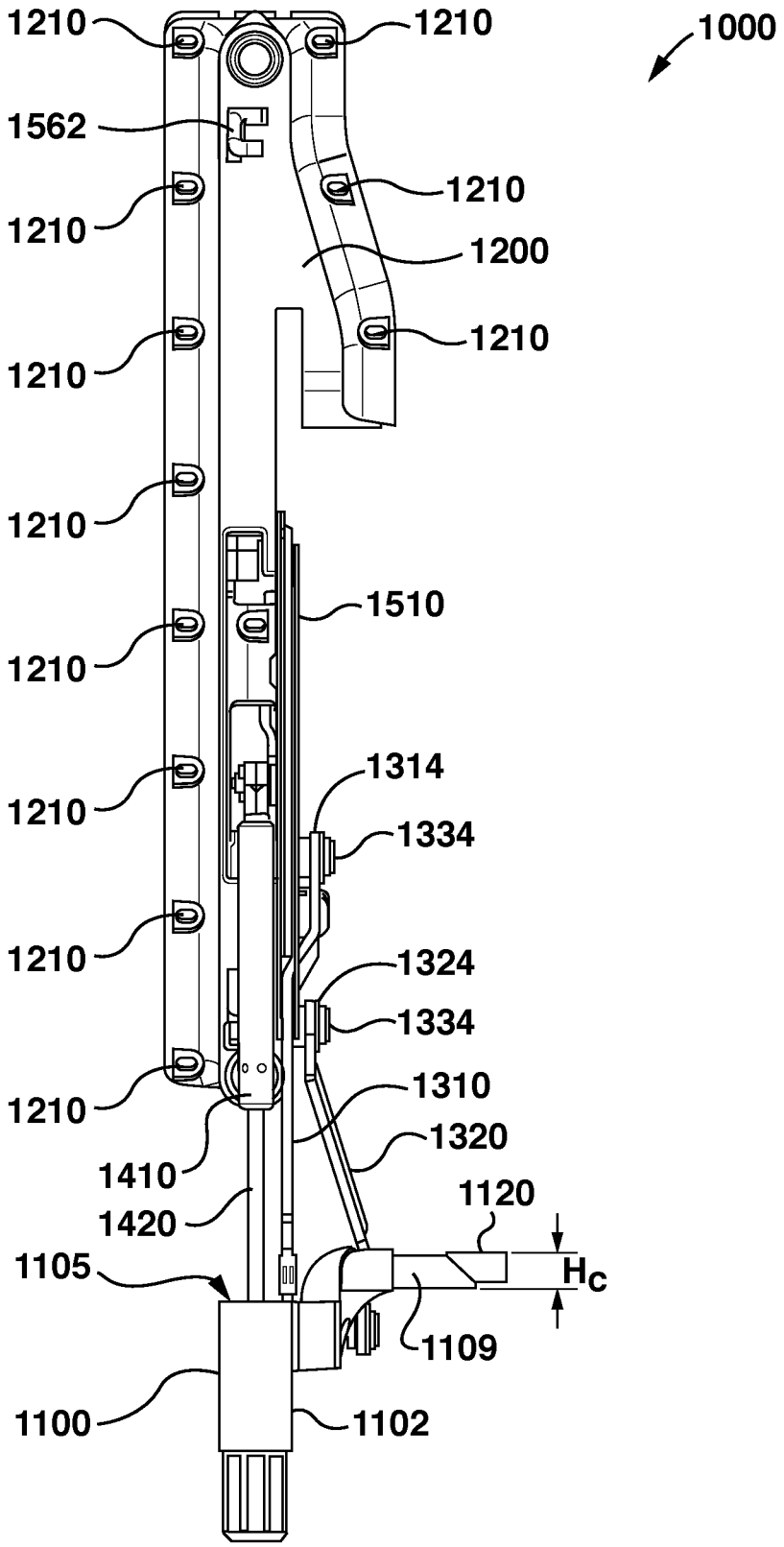
FIG. 5 is a front plan view of the apparatus of FIG. 1 in an extended position.

As shown, projections 1106, 1108 extend downwardly from lower end frame member 1100, and are configured for insertion into a hollow upper portion of the legs. It will be appreciated that other configurations of leg securement may be possible. For example, lower end frame member 1100 may alternatively have first and second bores or recesses into which an upper portion of table legs may be inserted and secured. Lower end frame member 1100 also has a horizontally extending projection 1109, for mounting to an end of a frame member (e.g. an elongate member 160 having a rectangular cross-sectional profile, as shown in e.g. FIG. 7). In the illustrated embodiment, projection 1109 is received in a hollow portion at an end of the longitudinal frame member 160. Projection 1109 may be secured to the frame member in any suitable manner. For example, as illustrated in FIGS. 2 and 5, projection 1109 may have an angled or chamfered end surface, and a retaining wedge 1120 having a complementary angled or chamfered end surface may be coupled to projection 1109 using a screw 1125. In such an arrangement, rotating the screw 1125 to 'pull' retaining wedge 1120 towards projection 1109 will, due to their respective angled surfaces, act to increase the vertical offset of the upper surface of wedge 1120 from the lower surface of projection 1109, resulting in an increase in the overall height $H_c$ of the coupled projection and wedge. In this way, the overall height $H_c$ may be increased after the projection 1109 and wedge 1120 have been inserted into an end of a frame member 160 to mechanically couple the lower end frame member 1100 to the frame member 160. It will be appreciated that the projection 1109 may be secured to the frame member 160 in any other suitable manner, such as using a set screw or other mechanical fastener, and/or an adhesive).

As shown, projection 1109 extends outwardly from lower end frame member 1100, and is configured for insertion into a hollow end portion of a frame member. It will be appreciated that other configurations may be possible. For example, lower end frame member 1100 may alternatively have one or more bores or recesses into which one or more projections extending from an end of a frame member may be inserted and secured.

Figure 12D:
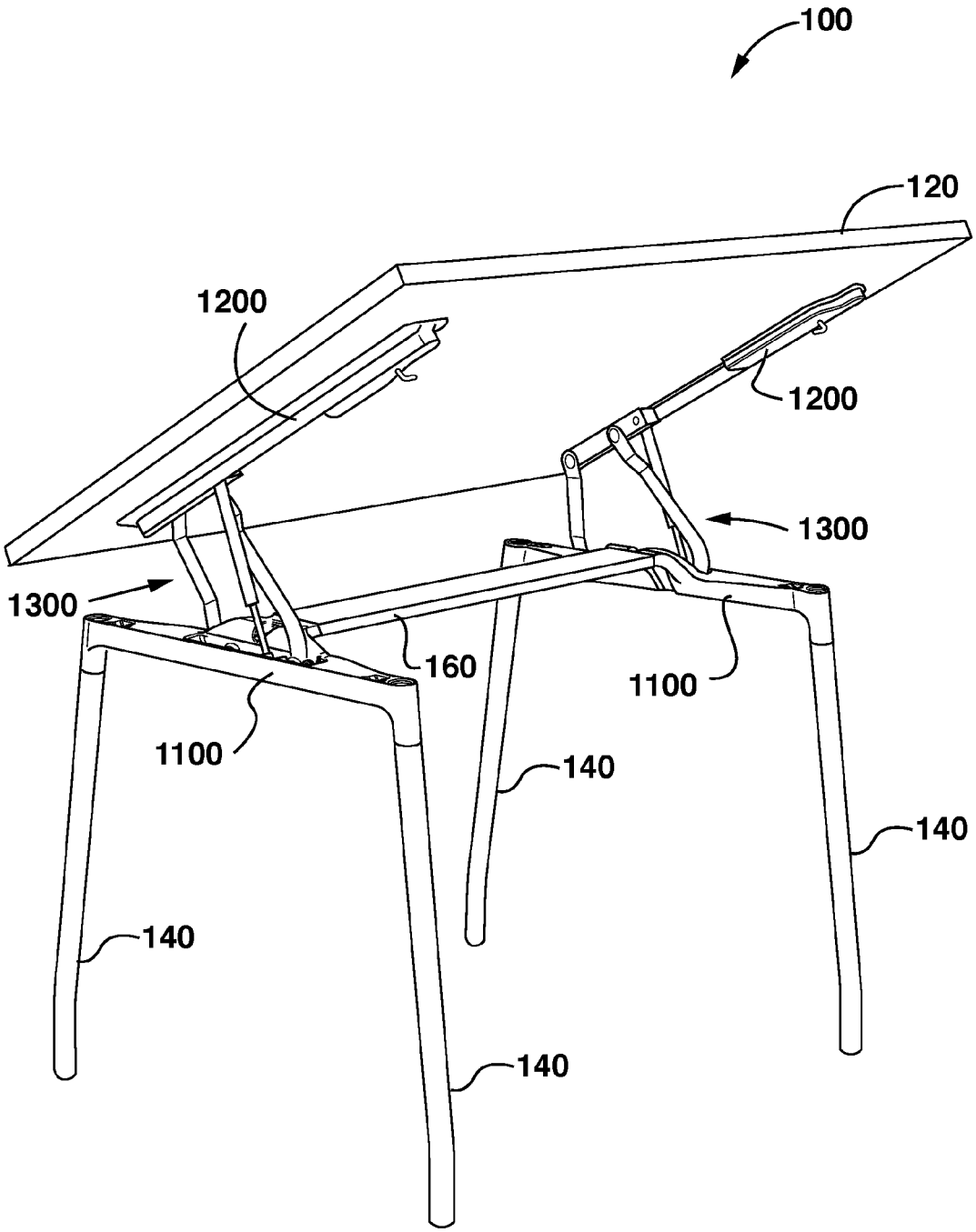
Figure 12E:
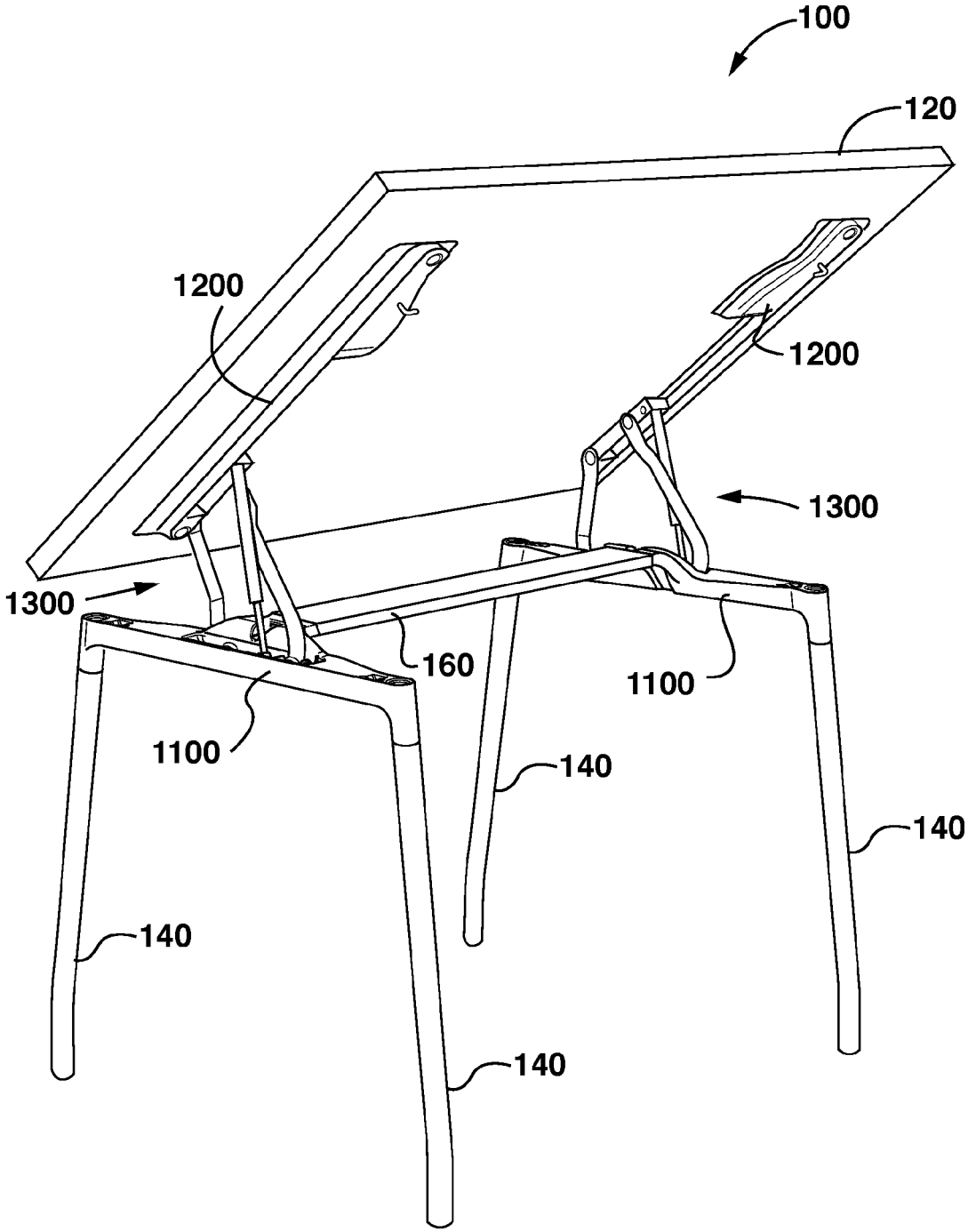
Figure 12F:
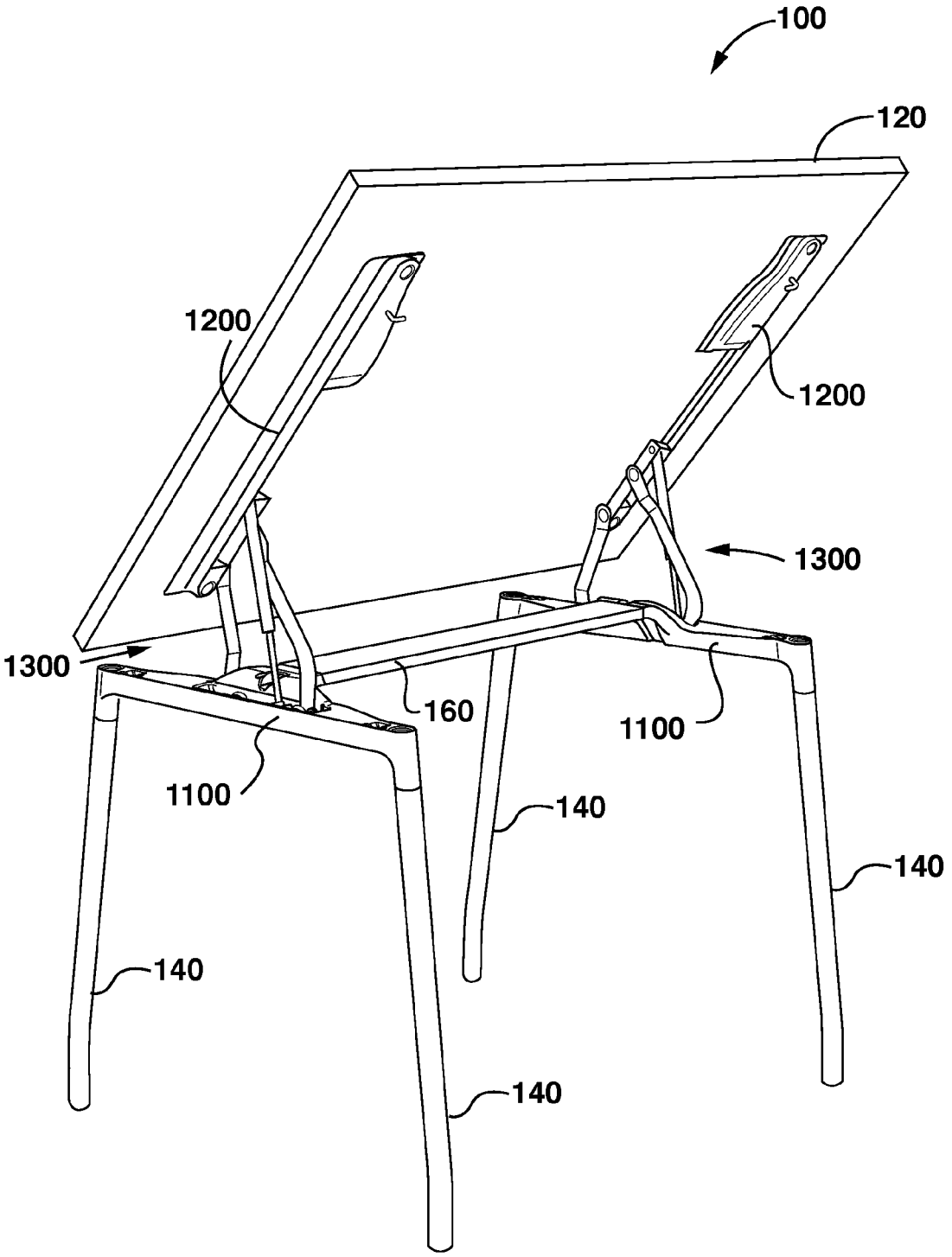
Figure 12G:
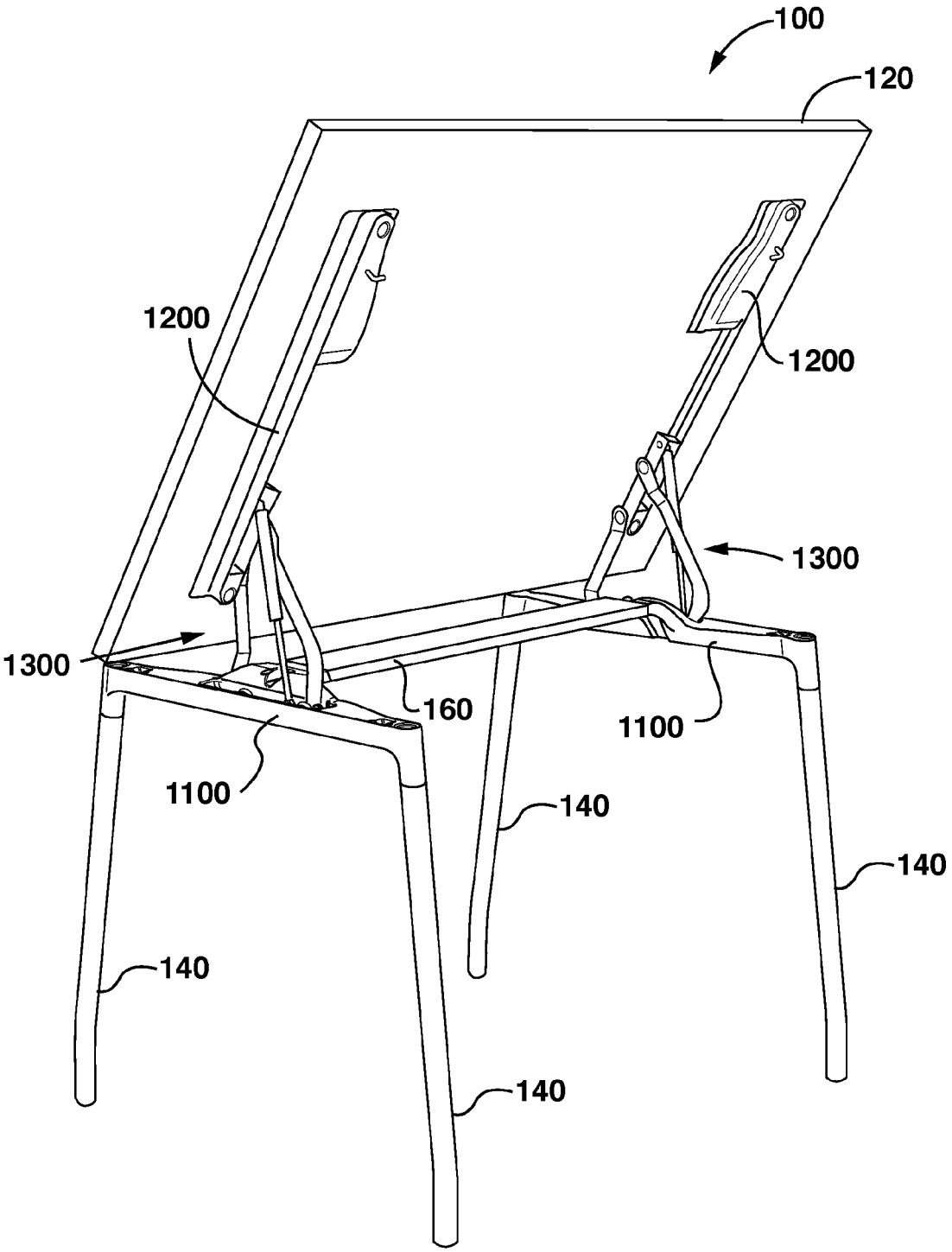

As shown in FIG. 12D, a pair of lower end frame members 1100 are secured to opposite ends of a longitudinal frame member 160, and a pair of legs 140 are secured to each lower end frame member. When secured, the four legs 140, lower end frame members 1100, and frame member 160 form the base of the furniture piece.

Returning to FIGS. 1 and 2, upper end frame member 1200 has an upper surface 1205 and a plurality of worksurface bores 1210 extending through the upper end frame member. Worksurface bores 1210 are adapted to receive a worksurface fastener so that a worksurface can be secured against the upper surface 1205 of upper end frame member 1200. Worksurface fasteners are preferably screws (e.g. hex cap screws or socket cap screws), but may be any type of fastener, including a fastener with a tapered shank (such as a self-tapping screw or a wood screw). In some embodiments, a threaded insert (not shown) may be secured in the worksurface for receiving the worksurface fastener.

The upper and lower end frame members 1200, 1100 are connected to each other by linkage 1300. Linkage 1300 guides the movement of the upper end frame member 1200 relative to lower end frame member 1100. Accordingly, as will be discussed further below with respect to FIGS. 12A to 12H, linkage 1300 guides the movement of the worksurface relative to the base of the furniture piece.

As shown in FIGS. 1 to 8, linkage 1300 includes a first arm 1310 and a second arm 1320. A first end 1312 of first arm 1310 is rotationally secured to lower end frame member 1100, and a second end 1314 of first arm 1310 is rotationally secured to upper end frame member 1200. Similarly, a first end 1322 of second arm 1320 is rotationally secured to lower end frame member 1100, and a second end 1324 of second arm 1320 is rotationally secured to upper end frame member 1200.

In the illustrated embodiment, each end of the arms 1310, 1320 are rotationally coupled to one of end frame members 1100, 1200 by positioning an arm sleeve 1330 in a bore 1335 at the end of the arm, positioning a pair of bushings 1332 within a bore of the arm sleeve 1330, and positioning a shoulder screw 1334 through the bushings 1332 and into a bore in the end frame member. In some embodiments, a threaded insert (not shown) may be secured in the end frame member for receiving the shoulder screw 1334.

When arms 1310, 1320 are rotationally secured to the upper and lower end frame members 1200, 1100, the arms and end frame members may be characterized as a four-bar linkage. It will be appreciated that the lengths of the arms 1310, 1320 (i.e. $L_1$, $L_2$ in FIG. 4A) and/or the spacing of their mounting points on the end frame members (i.e. $L_3$, $L_4$ in FIG. 4A) may be selected based on dimensions of the furniture piece (e.g. the length, width, and mass of the worksurface, etc.), and/or to provide a desired travel path for the worksurface.

Apparatus 1000 is shown with an optional biasing member 1400 for imparting a force onto the upper end frame member when the worksurface is being adjusted.

Biasing member 1400 is preferably configured to be biased towards an extended state. In the illustrated embodiment, biasing member 1400 comprises a gas spring, which may also be referred to as a gas piston. The gas piston has a cylinder 1410 (which may be referred to as a pressure tube) and an internal piston (not shown) with a piston rod 1420 extending from one end of the cylinder 1410. The gas spring is filled with compressed gas (e.g. nitrogen) that provides the spring force.

Gas piston 1400 is thus normally biased toward an extended state, e.g. piston rod 1420 is normally extended from cylinder 1410. Pushing piston rod 1420 towards and into the cylinder 1410 reduces the volume in the cylinder and the gas is further compressed. This creates an increase in force for the gas spring which, as will be appreciated, depends on e.g. the diameter of the piston rod and the volume of the cylinder.

The internal piston may also have a small opening (e.g. a nozzle) through which gas can flow, thus allowing the piston rod to move inwardly and/or outwardly from the cylinder 1410 at a defined speed. Thus, gas spring 1400 can be configured to impart a force on a worksurface at a relatively constant rate of motion (i.e. at a substantially constant velocity). It will be appreciated that variant designs of gas pistons or other suitable biasing members may be used in alternative embodiments. It will also be appreciated that the cylinder size, stroke length, and/or extension force of gas piston 1400 may be selected based on e.g. the mass of the worksurface, travel distance, etc. For example, gas piston 1400 may have an extension force of from about 150 to about 350 N, and have a travel of from about 80 to about 100 mm.

In the illustrated embodiment, an end 1405 of the gas piston is rotationally coupled to upper end frame member 1200 using a clevis pin 1430 and a cotter pin 1435, and an end 1425 of the piston rod 1420 is rotationally coupled to lower end frame member 1100 using a clevis pin 1430 and a cotter pin 1435. It will be appreciated that any suitable rotational coupling method may alternatively be used.

Figure 3A:
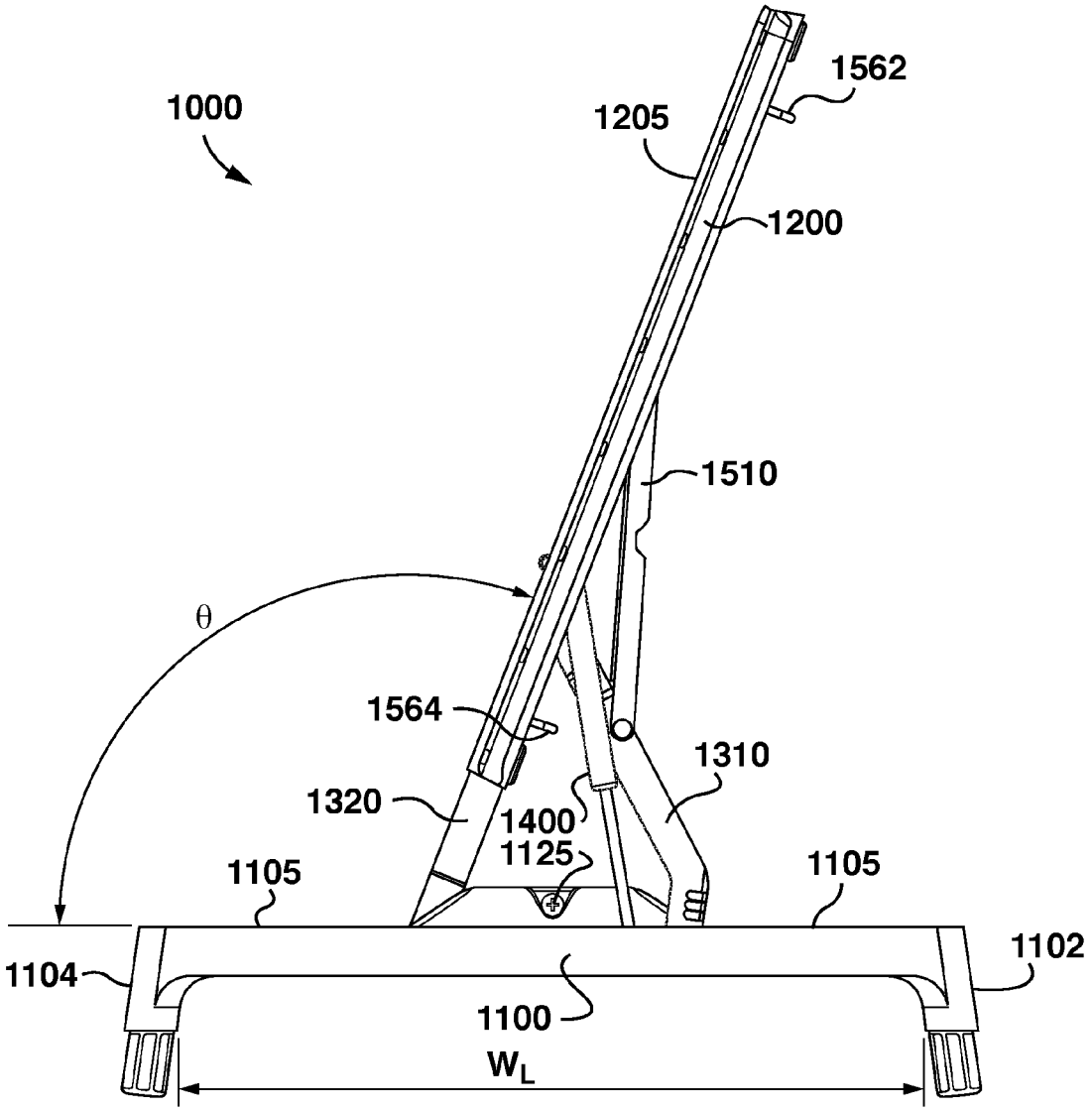
FIG. 3A is an exterior plan view of the apparatus of FIG. 1 in an extended position.
Figure 3B:
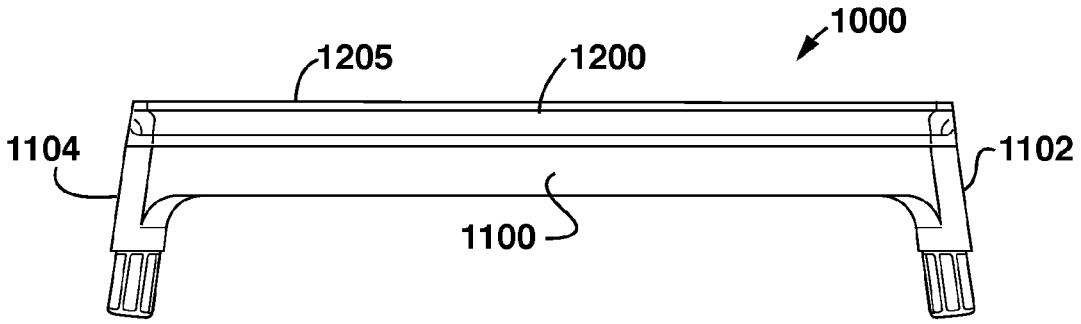
FIG. 3B is an exterior plan view of the apparatus of FIG. 1 in a retracted position.
Figure 4A:
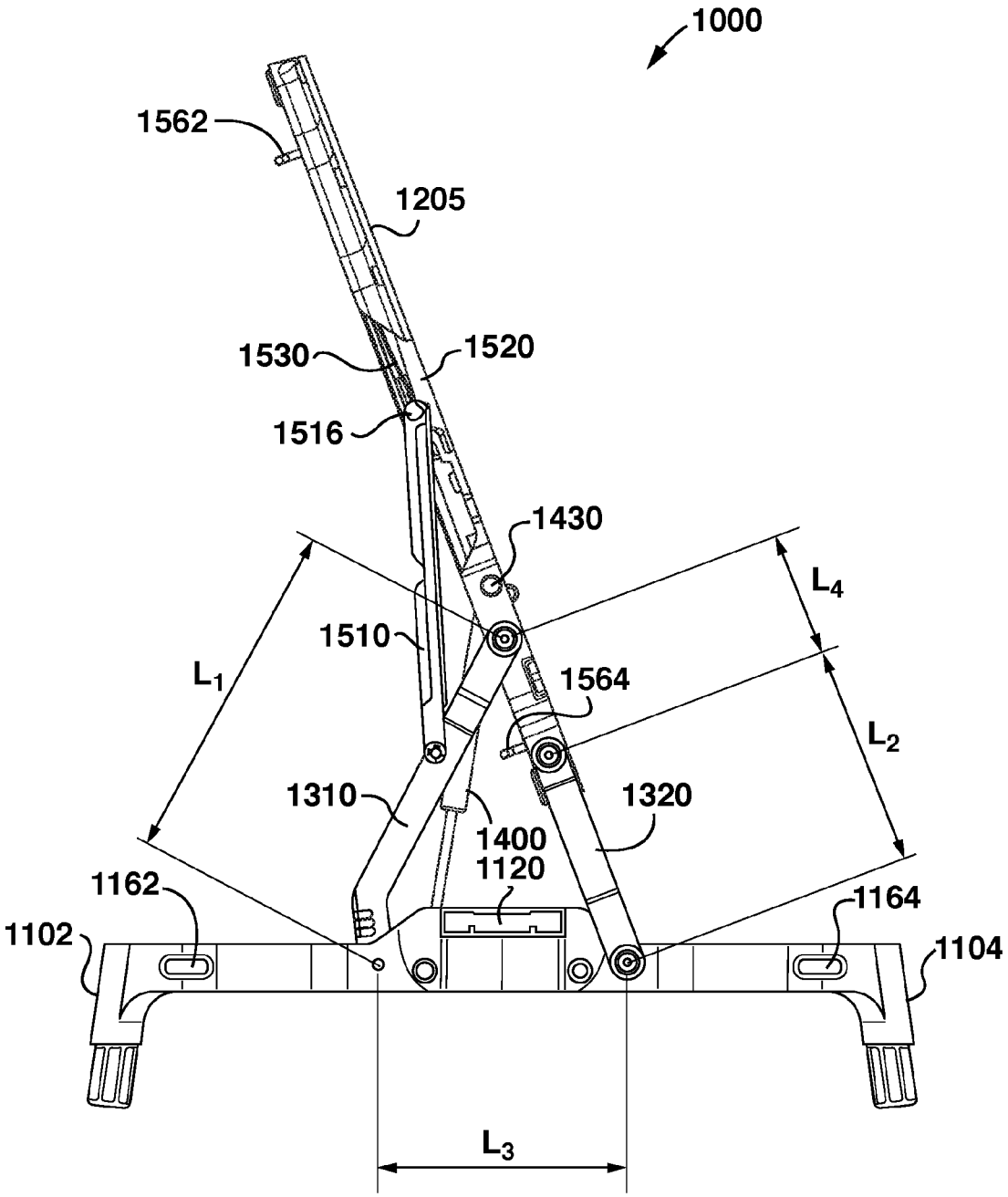
FIGS. 4A-G are a series of interior plan views of the apparatus of FIG. 1 being adjusted from the extended position of FIG. 4A to the retracted position of FIG. 4G.
Figure 4B:
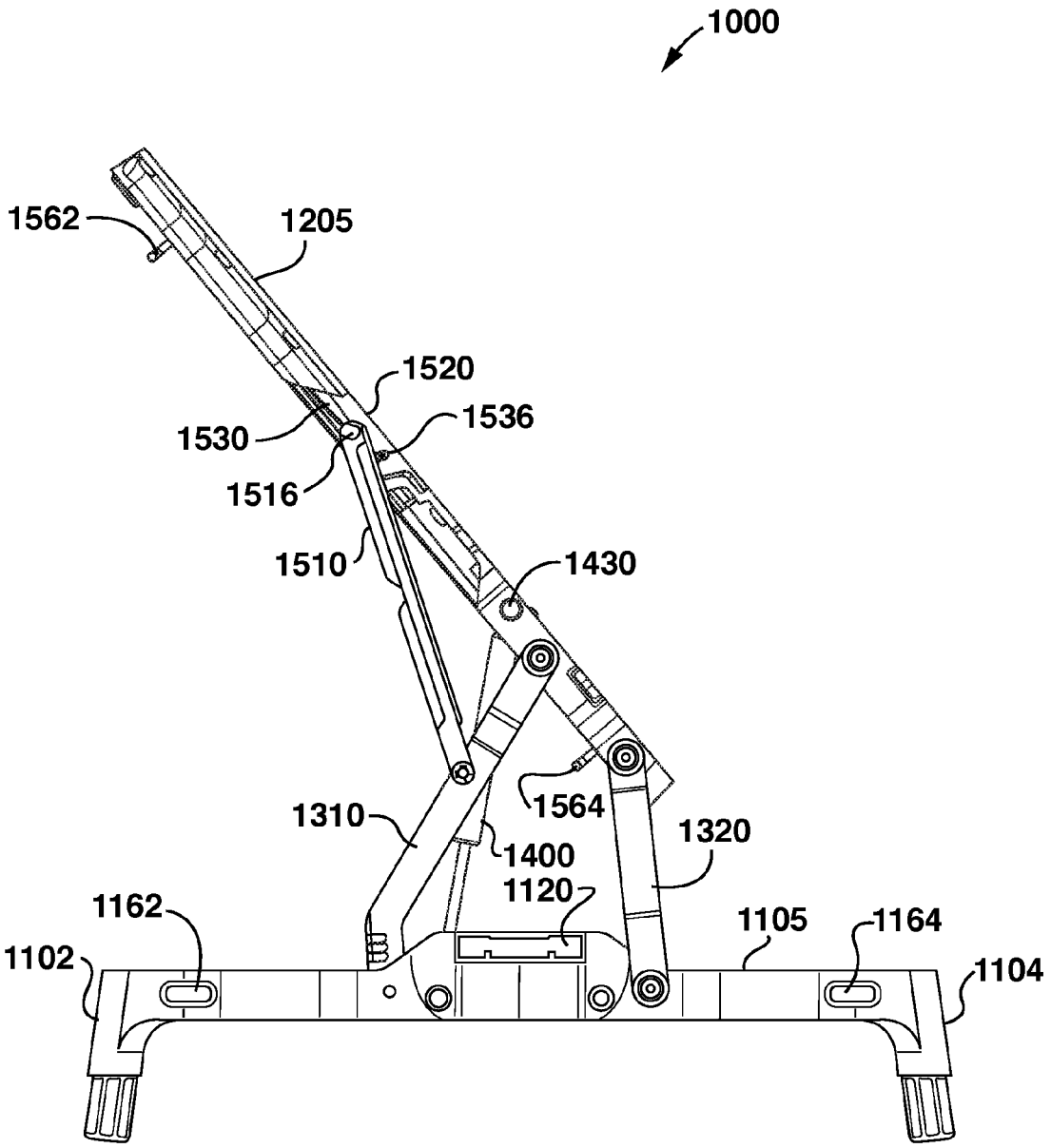
Figure 4C:
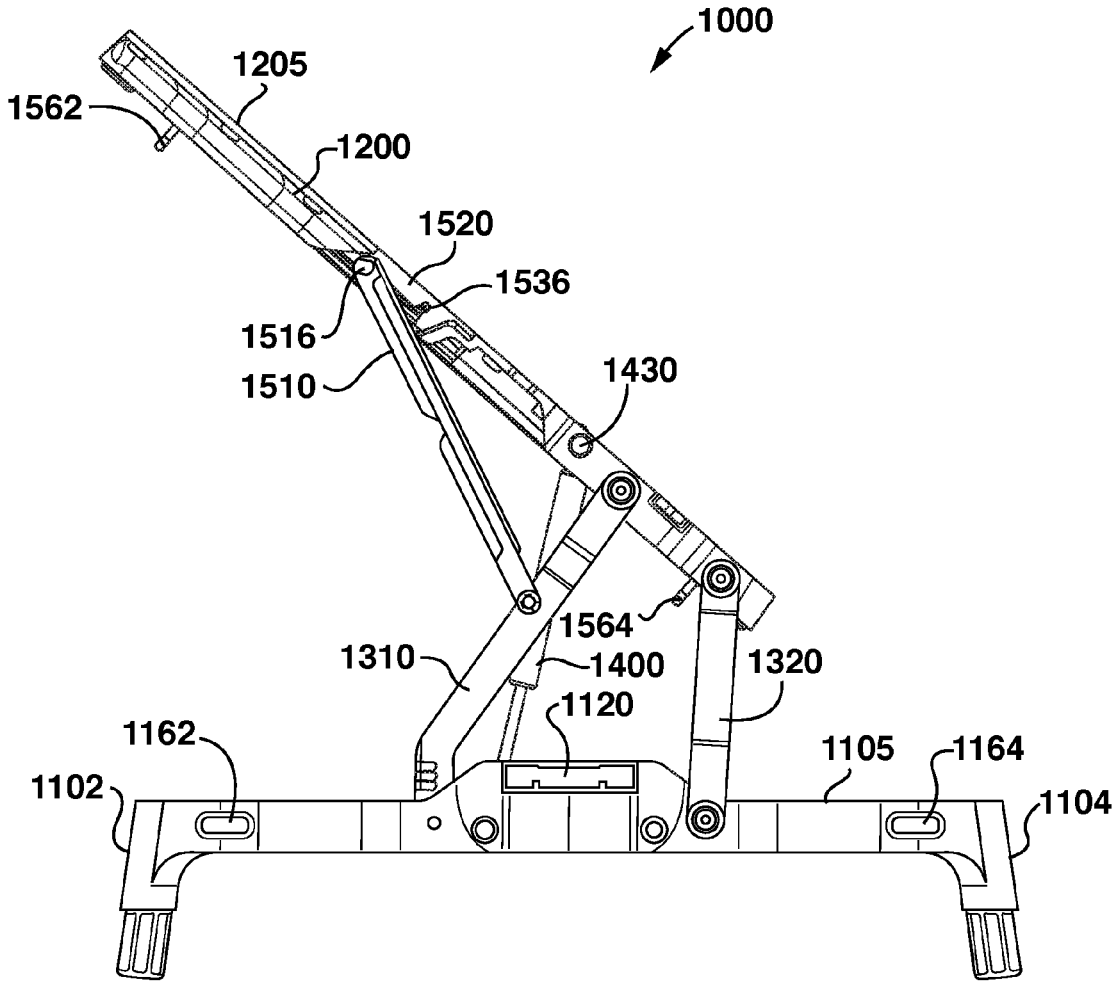
Figure 4D:
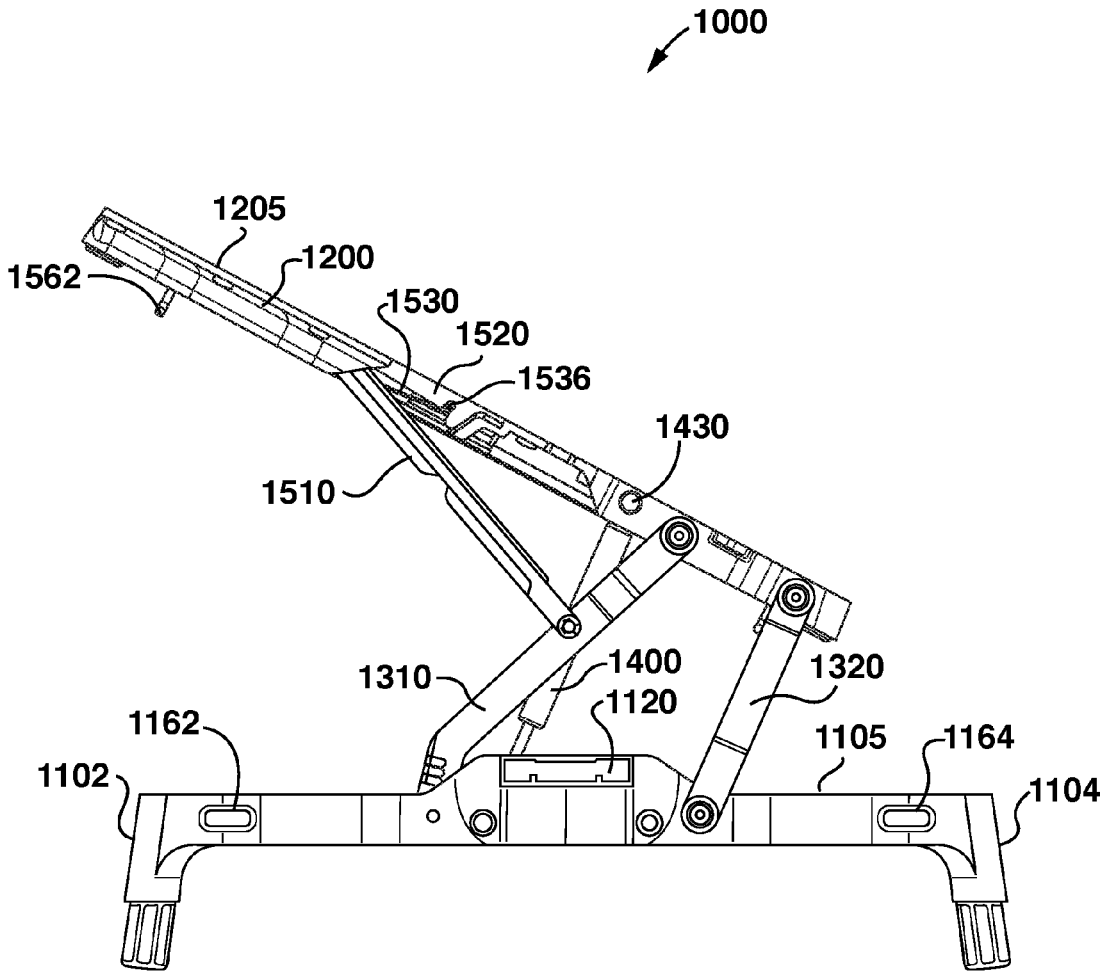
Figure 4E:
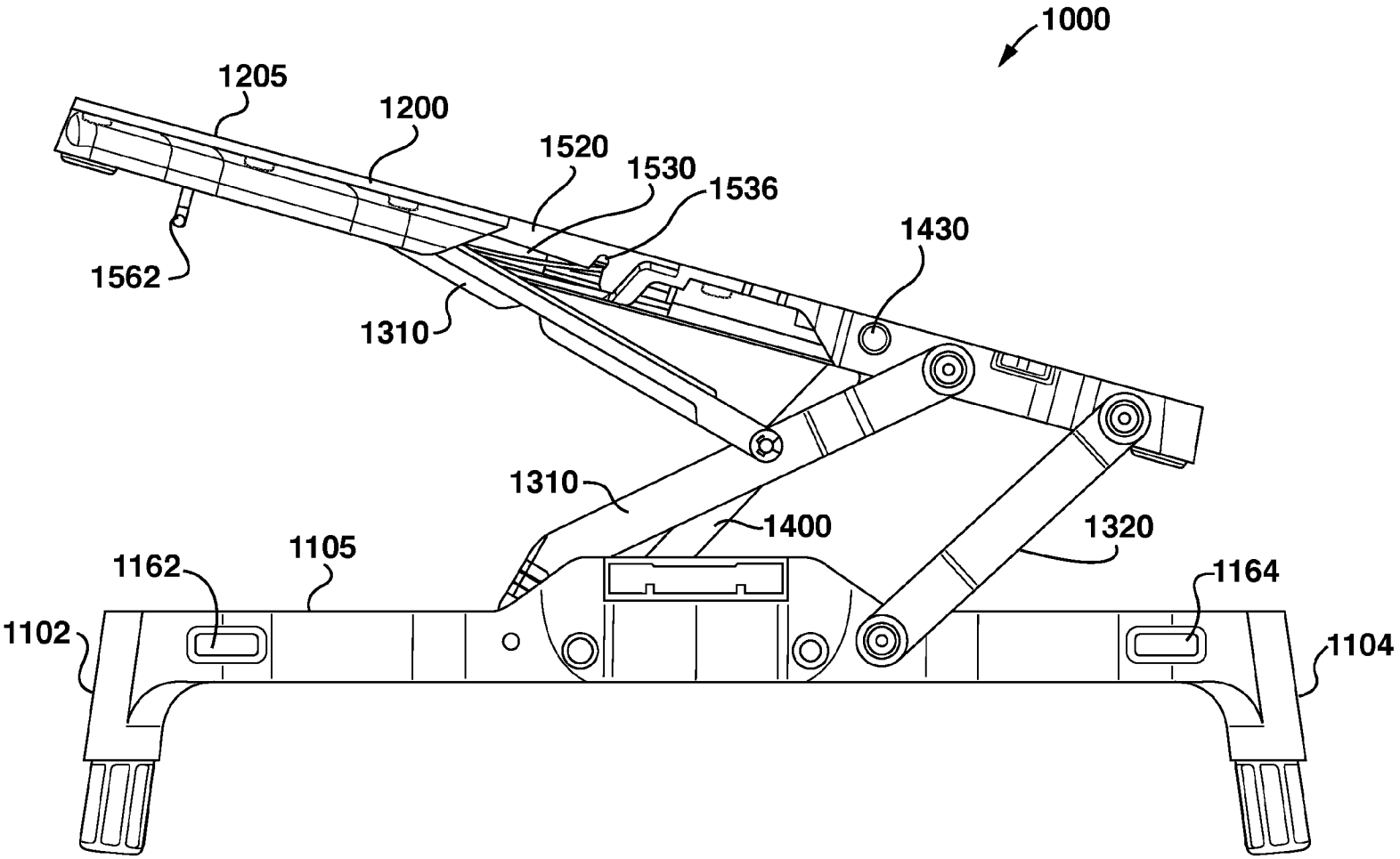
Figure 4F:
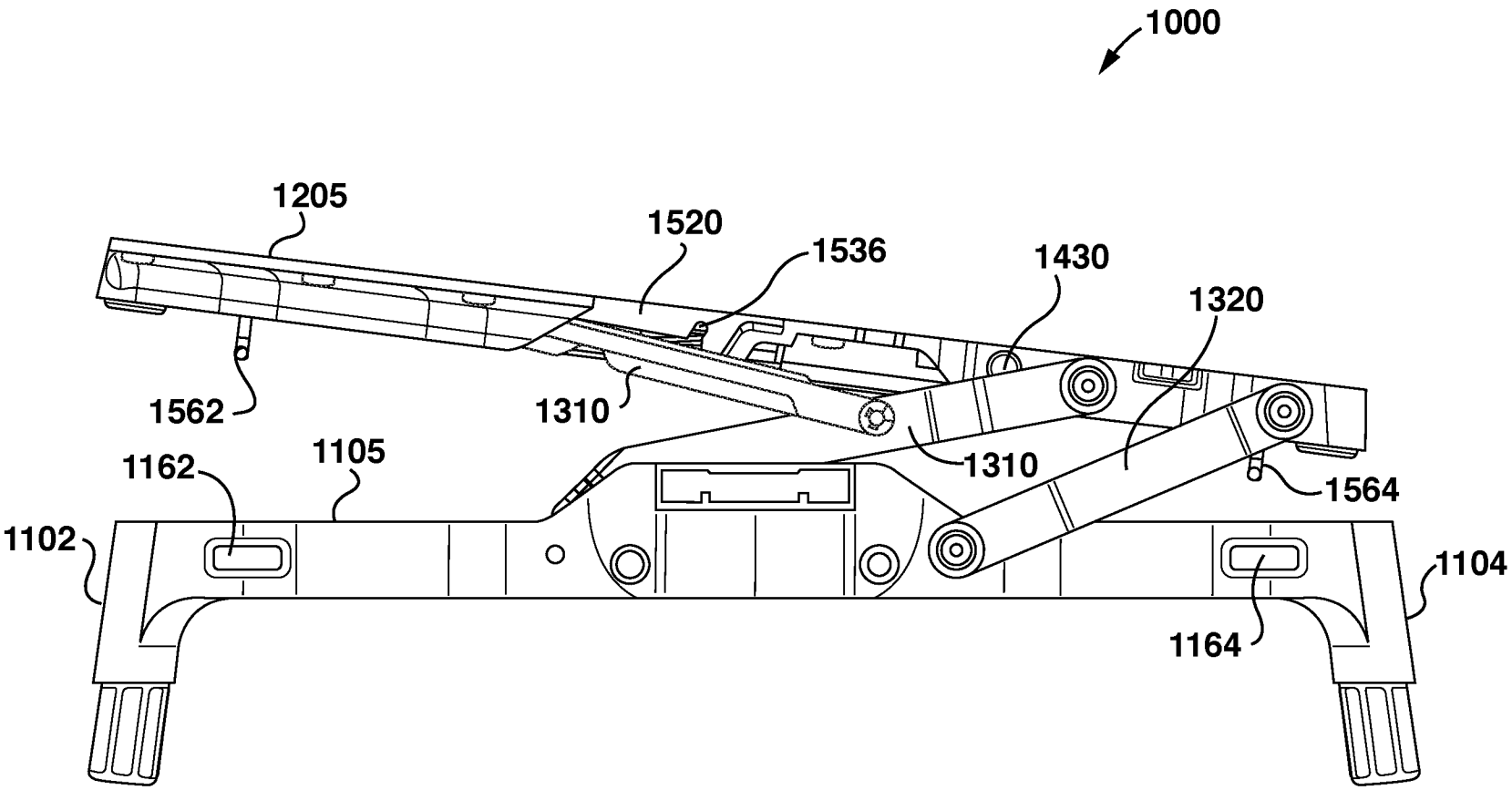
Figure 4G:
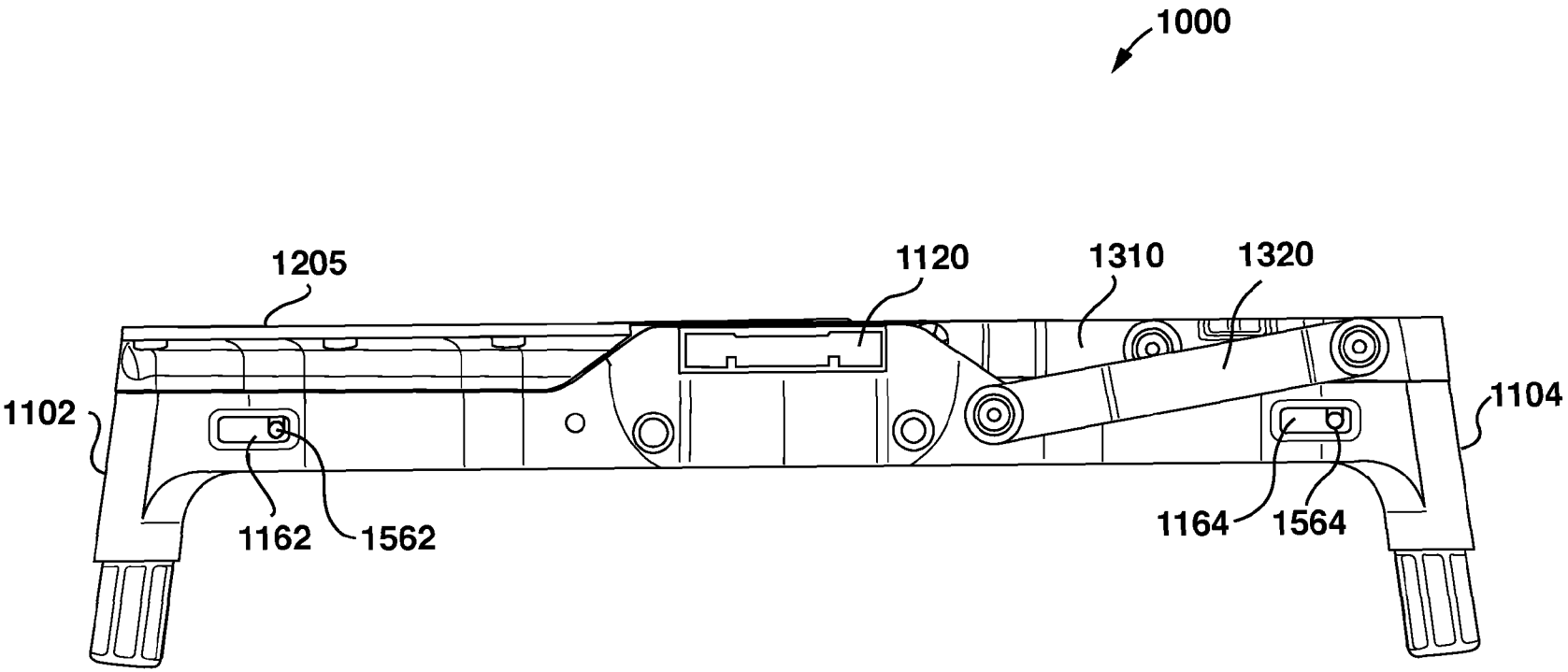
Figure 7:
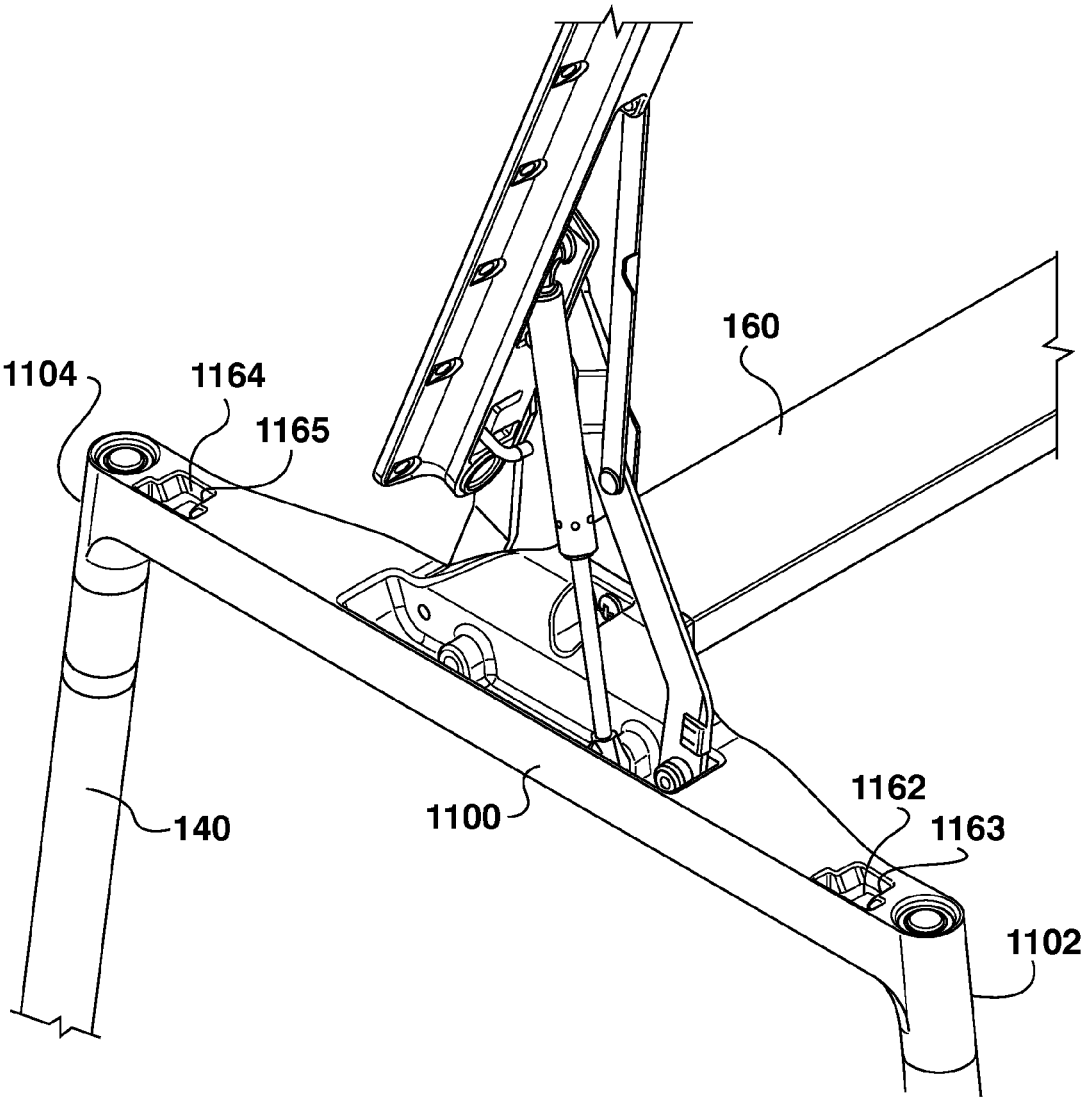
FIG. 7 is an exterior perspective view of the apparatus of FIG. 6 in an extended position.
Figure 8:
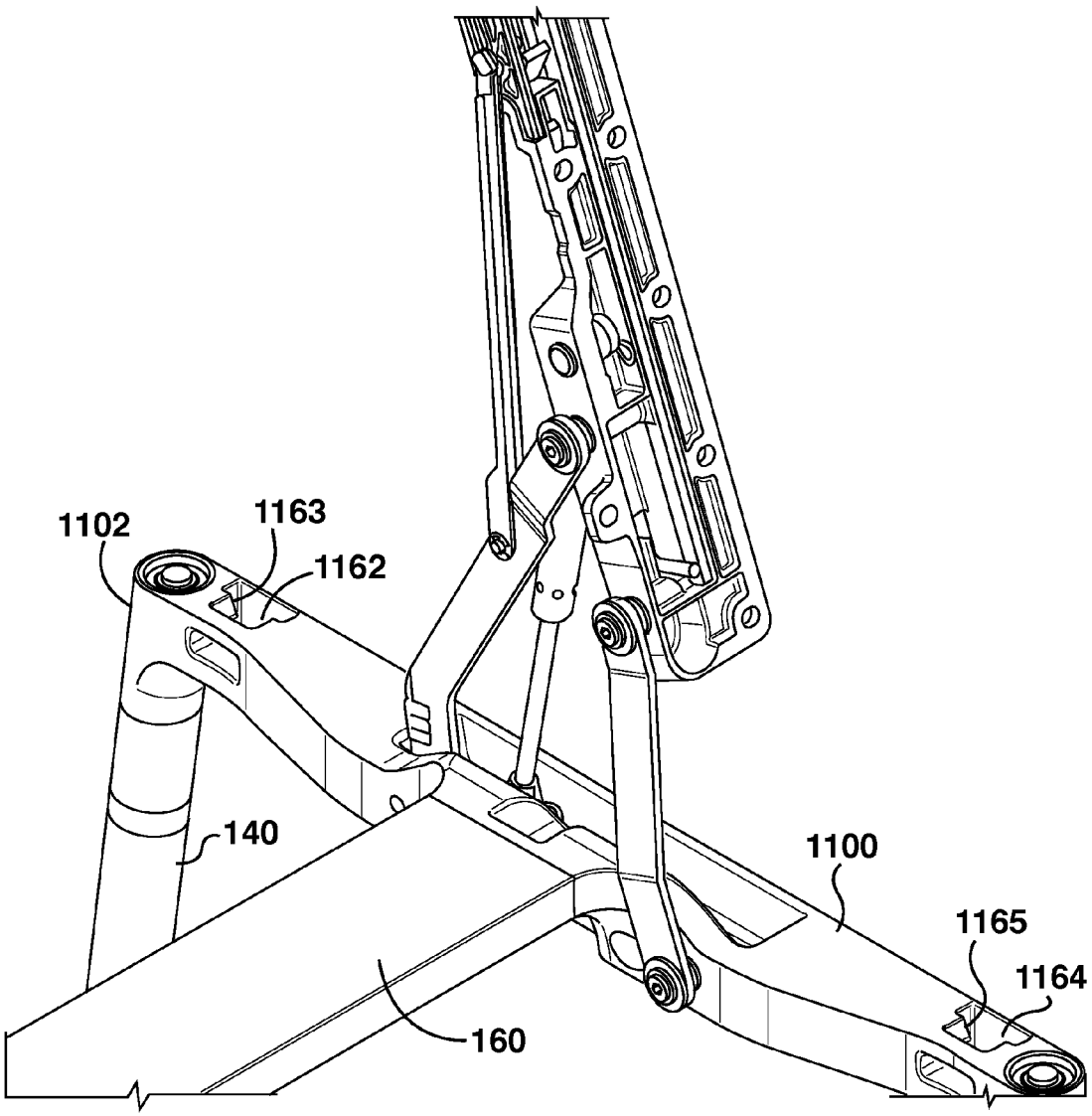
FIG. 8 is an interior perspective view of the apparatus of FIG. 6 in an extended position.

Notably, as seen in FIGS. 4A and 8, the mounting location of the end 1425 of the piston rod 1420 on lower frame member 1100 is between the mounting locations of the lower ends 1312, 1322 of arms 1310, 1320, and the mounting location of the other end 1405 of the gas piston on upper frame member 1200 is outside (i.e. not between) and closer to the upper surface 1205 of the upper frame member 1200 than the mounting locations of the upper ends 1314, 1324 of arms 1310, 1320. In this configuration, when the upper and lower end frame members are positioned as shown in FIGS. 3B, 4G, 6, and 12A, the extension force exerted by the gas piston does not urge relative motion between the upper and lower end frame members, and may urge the upper and lower end frame members to maintain this relative position. However, once the upper end frame member is moved relative to the lower end frame member (e.g. by a user imparting a force on the worksurface), the extension force exerted by the gas piston urges the upper and lower end frame members towards the relative position shown in FIGS. 1, 3A, 4A, 5, 7, and 8.

The operation of a furniture piece with an adjustable worksurface will now be described with reference to FIGS. 12A to 12H.

FIGS. 12A-12H show an assembled table 100 that has a worksurface 120 secured to a base formed by a pair of end frame mechanism 1000, and a longitudinal frame member 160 (not visible in FIG. 12A), and four legs 140. As shown, each leg 140 comprises a tubular member with a slight bend near the lower end of the leg. However, it will be appreciated that any suitable legs may be used.

In FIG. 12A, the worksurface 120 is in a substantially horizontal orientation, and the upper and lower end frame members are positioned as shown in FIGS. 2B, 3B, 4B, and 5.

Figure 12H:
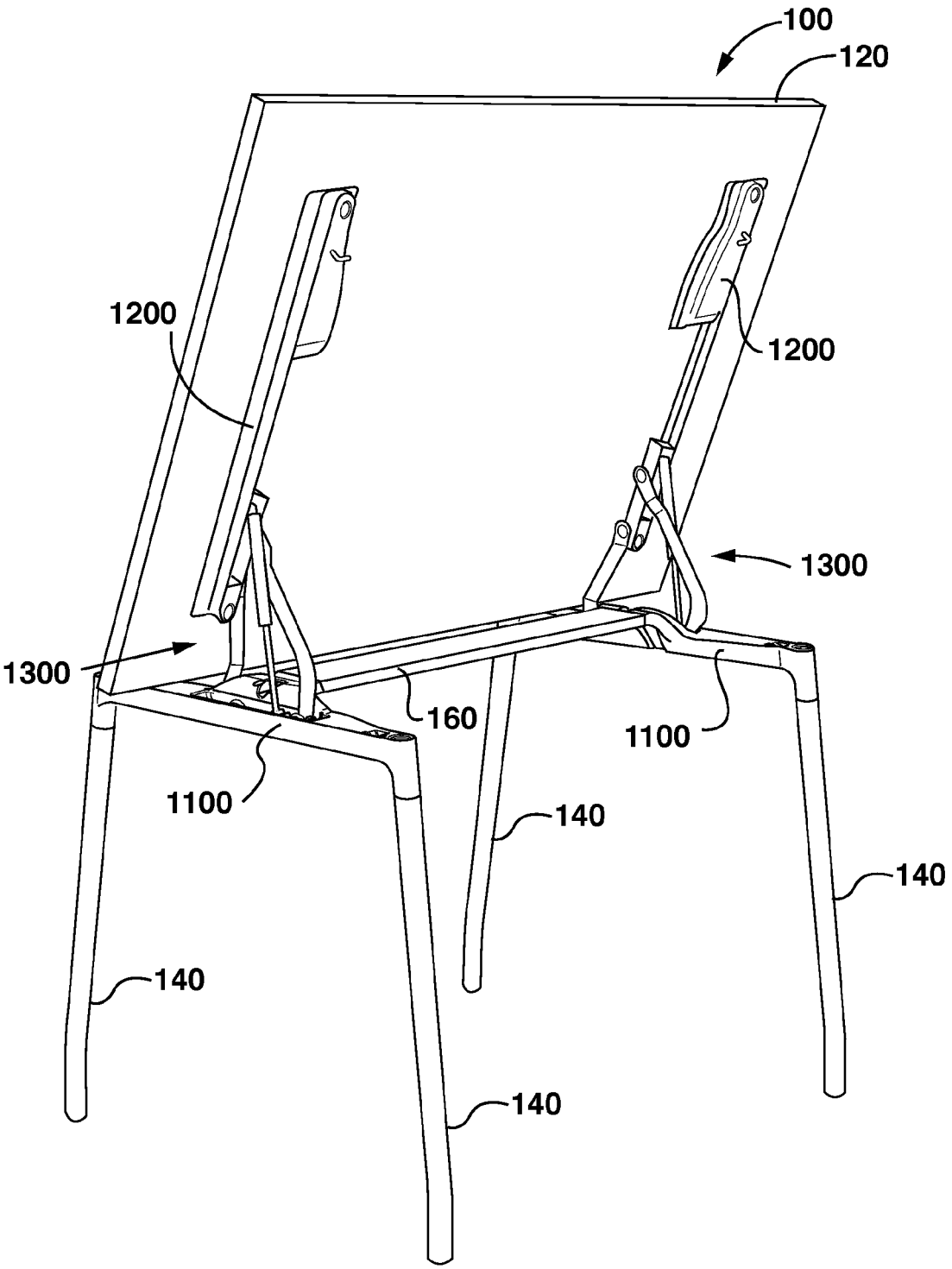

As shown in FIGS. 12B to 12H, end frame mechanisms 1000 allow worksurface 120 to be adjusted between a substantially horizontal or first position, e.g. as shown in FIG. 12A, and an inclined or second position, e.g. as shown in FIG. 12H. Specifically, linkage 1300 allows and guides upper end frame members 1200 (which are secured to the underside of worksurface 120) to be moved relative to lower end frame members 1100 (which form part of the table base), thereby allowing worksurface 120 to be adjusted between the level and inclined positions.

In the inclined position shown in FIG. 12H, the angle between worksurface 120 and a horizontal plane defined by the upper surfaces 1105 of lower end frame members 1100 is about 70 degrees (e.g. the angle θ in FIG. 2A is about 110 degrees). It will be appreciated that the maximum angle of inclination may be larger or smaller in alternative embodiments. Preferably, the maximum angle of inclination is greater than 45 degrees (e.g. the angle θ in FIG. 2A is less than 135 degrees).

As noted above, as the worksurface is adjusted from the level position towards the inclined position shown in FIG. 12H, biasing member 1400 is able to extend and urge worksurface 120 towards the inclined position. As the gas spring 1400 imparts a force on the upper and lower end frame members, a relatively smooth inclination of worksurface 120 may be achieved, particularly where the biasing member is damped (i.e. extends at a relatively constant velocity).

Also, the linkages 1300 and/or gas pistons 1400 are preferably configured so that when worksurface 120 is in the inclined position (e.g. as shown in FIG. 12H), the force exerted by the gas pistons 1400 on the upper end frame members 1200 (and thus, on worksurface 120) is sufficient to hold worksurface 120 in the inclined position without the need for a separate locking mechanism. The linkages 1300 and/or gas pistons 1400 are also preferably configured so that the force required to lower worksurface 120 from the inclined position to the level position is capable of being applied by a user without undue effort. It will be appreciated that the configuration of linkages 1300 and/or gas pistons 1400 may depend on, e.g., the geometry and/or mass of worksurface 120.

Figure 13:
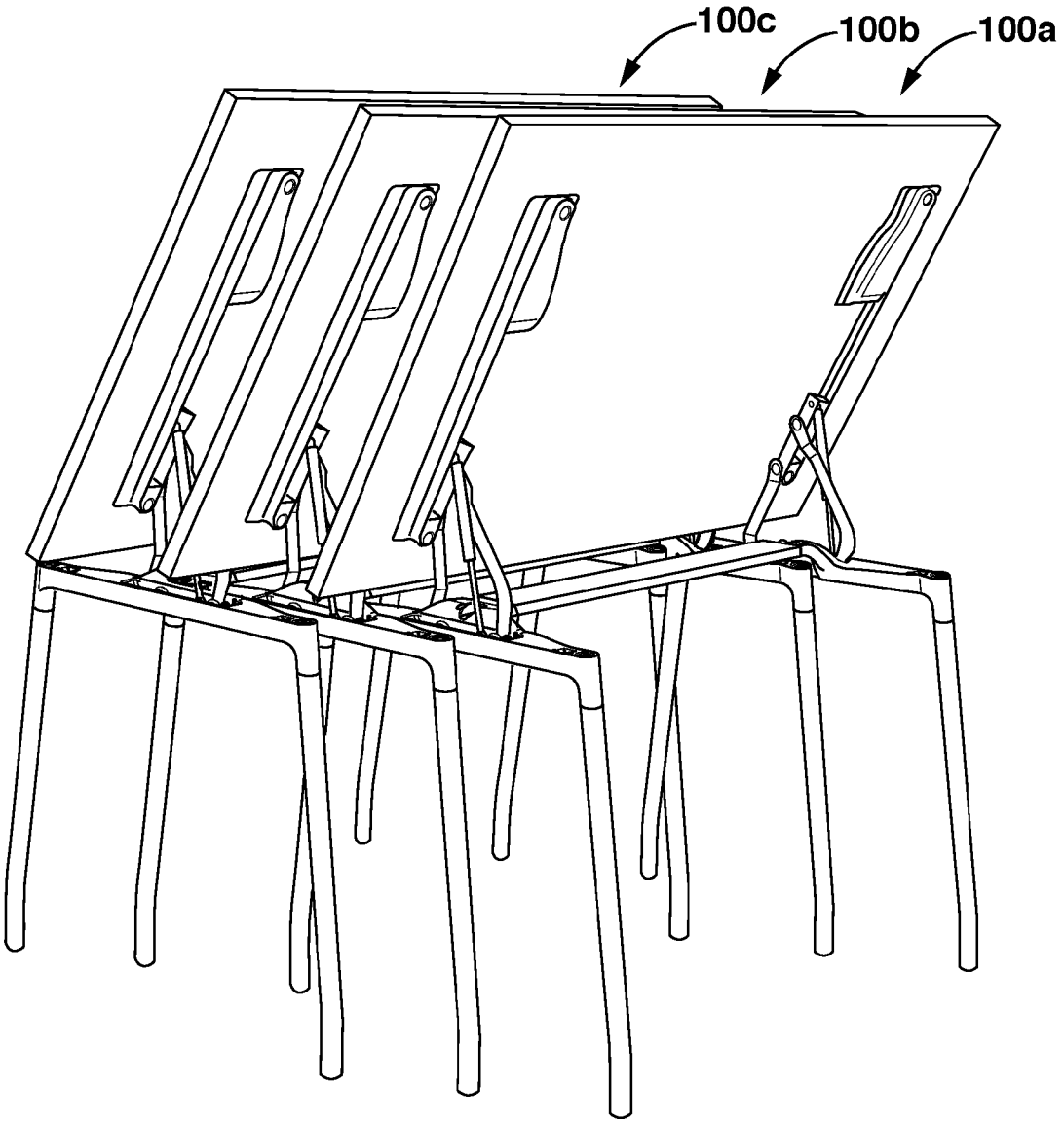
FIG. 13 is a perspective view of a plurality of furniture pieces in a nested configuration with their worksurfaces in inclined positions.

Notably, during adjustment of worksurface 120 between the level position and the inclined position, the entire worksurface 120 remains above a horizontal plane defined by the upper surfaces 1105 of lower end frame members 1100. This may have one or more advantages as compared to typical 'flip-top' tables in which the worksurface is rotated about a longitudinal axis, whereby, in an inclined position, a portion of the worksurface is below the axis of rotation. For example, as shown in FIG. 13, a plurality of tables 100*a-c* may be nested together when their worksurfaces 120*a-c* are in inclined positions. As another example, unlike a table with central leg and/or pivot supporting the worksurface between the end frames, when the worksurface is in an inclined position a user may sit between the end frames and use the worksurface, e.g. as drawing table.

Also, end frame mechanisms 1000 allow the upper ends of legs 140 to be spaced apart from each other. For example, the distance $W_L$ between projections 1106, 1108 (see FIG. 3A) may be from about 350 mm (e.g. for a table having a worksurface depth of about 610 mm) to about 510 mm (e.g. for a table having a worksurface depth of about 760 mm). Accordingly, at each end of the support frame, the upper ends of legs 140 are spaced apart from each other by about 350 to about 510 mm. This leg spacing may allow a user seated at an end of table 100 to position a portion of their legs and/or a portion of their chair between the legs 140 of the table. This may have one or more advantages as compared to typical 'flip-top' tables in which the ends of the support frame have a central support column and/or two or more legs that converge proximate the support frame. In such prior art tables, it may be considered difficult and/or uncomfortable to sit at the end of the table due to the obstruction created by a central support or closely spaced legs.

Apparatus 1000 preferably includes an optional latching mechanism for positively restraining the upper and lower end frame members in a retracted position (e.g. as shown in 3B, 4G, 6, and 12A).

Figure 6:
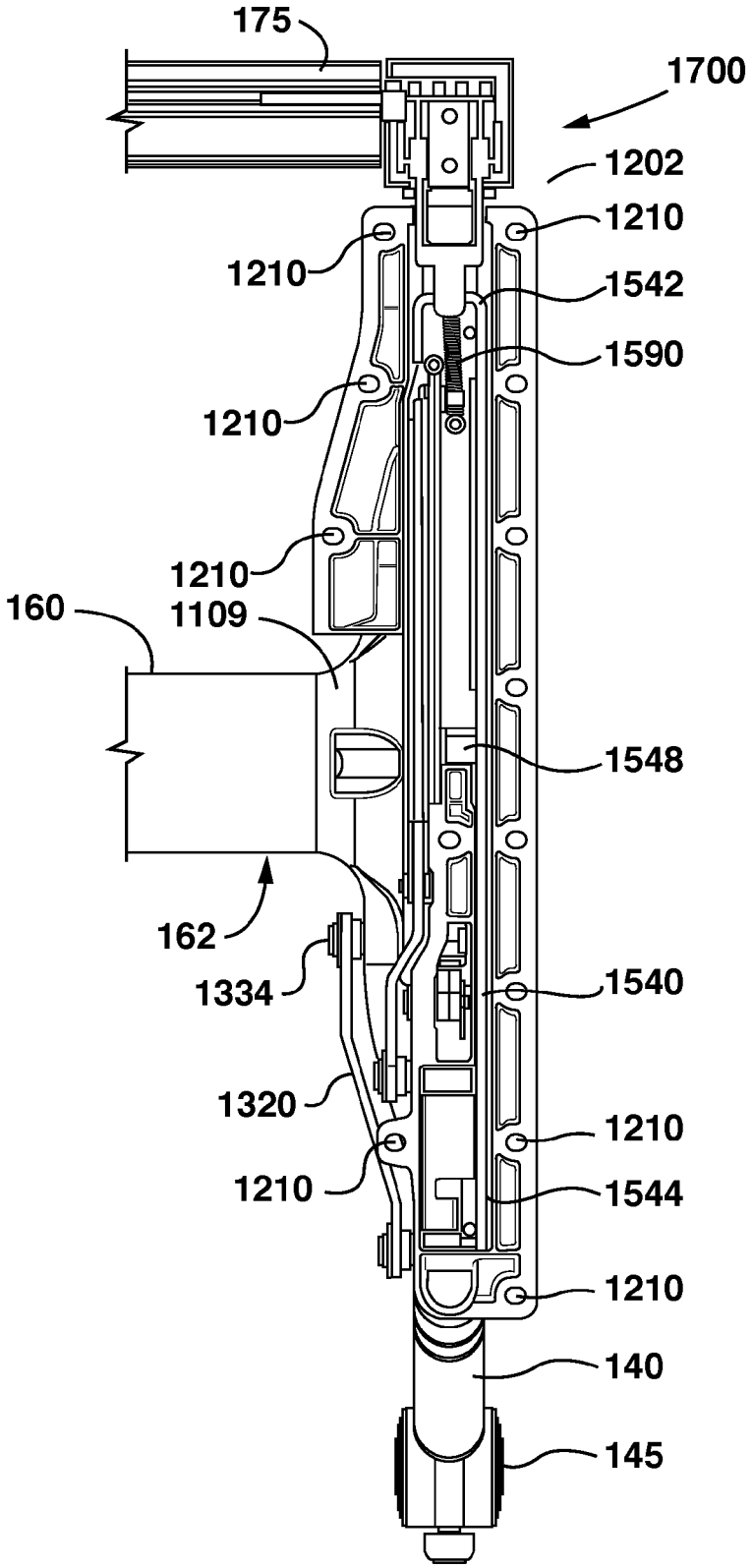
FIG. 6 is a top plan view of the apparatus of FIG. 1 in a retracted position and secured to a frame member and a pair of legs.

As shown in FIGS. 1, 2, and 6, latching bar 1540 has a first end 1542 and a second end 1544. A first latching protrusion or hook 1562 extends from first end 1542, and a second hook 1564 extends from first end 1542. While two hooks are illustrated, it will be appreciated that more or fewer hooks could be provided in variant embodiments, and that latching protrusions of other shapes could alternatively be used.

As shown in FIGS. 1, 3A, and 7, latching bar 1540 is mounted to upper end frame member 1200 with the hooks 1562, 1564 extending through apertures provided in a lower surface of upper end frame member 1200.

As illustrated in FIGS. 1, 2, 7, and 8, upper surface 1105 of lower end frame member 1100 has first and second recesses 1162, 1164 configured to receive hooks 1562, 1564 when upper and lower end frame members 1200, 1100 are in a retracted position. As best seen in FIGS. 7 and 8, each recess 1162, 1164 has at least one hook engagement protrusion 1163, 1165 that obstructs a portion of its respective recess.

Latching bar 1540 is mounted to upper end frame member 1200 in a manner that allows latching bar 1540 to be displaced (e.g. slid) longitudinally relative to upper end frame member 1200. Such an arrangement allows hooks 1562, 1564 to be displaced (e.g. slid) between an unlatched position in which the hooks are closer to first end 1202 of upper end frame member 1200 and a latched position in which the hooks are closer to second end 1204. Preferably, latching bar 1540 is mechanically biased towards the latched position, e.g. using spring 1590 or a suitable alternative biasing member.

In such an arrangement, when upper and lower end frame members 1200, 1100 are in the retracted position with hooks 1562, 1564 positioned in recesses 1162, 1164 and with the latching bar 1540 in the latched position, hooks 1562, 1564 and hook engagement protrusions 1163, 1165 cooperatively retain (e.g. latch) the upper and lower end frame members 1200, 1100 in the retracted position. To release the upper and lower end frame members 1200, 1100 from the retracted position, latching bar 1540 may be displaced (e.g. slid) longitudinally to the unlatched position, in which the hook engagement protrusions 1163, 1165 no longer prevent hooks 1562, 1564 from being removed from recesses 1162, 1164.

Referring now to FIG. 8, an upper surface of each hook engagement protrusion 1163, 1165 is preferably beveled, chamfered, or otherwise angled to act as a cam surface. As the upper and lower end frame members 1200, 1100 are brought into the retracted position, contact between lower surfaces of hooks 1562, 1564 and the upper surfaces of the hook engagement protrusion 1163, 1165 directs the hooks 1562, 1564 and the latching bar 1540 towards the unlatched position. This allows the upper and lower end frame members 1200, 1100 to be latched in the retracted position without requiring a user to directly displace the latching bar 1540.

Apparatus 1000 also preferably includes an optional lockout mechanism for positively restraining the upper and lower end frame members and in an extended position (e.g. as shown in FIGS. 1, 3A, 4A, 5, 7, and 8). An example lockout mechanism includes a lockout arm 1510, a lockout arm guide 1520, and latching bar 1540.

As shown in FIGS. 1 to 4E, a first end 1512 of lockout arm 1510 is pivotably secured to a central portion of first arm 1310. A guide protrusion 1516 at the second end 1514 of lockout arm 1510 is positioned in a path 1530 defined by lockout arm guide 1520, which is itself secured to upper end frame member 1200.

Figure 9:
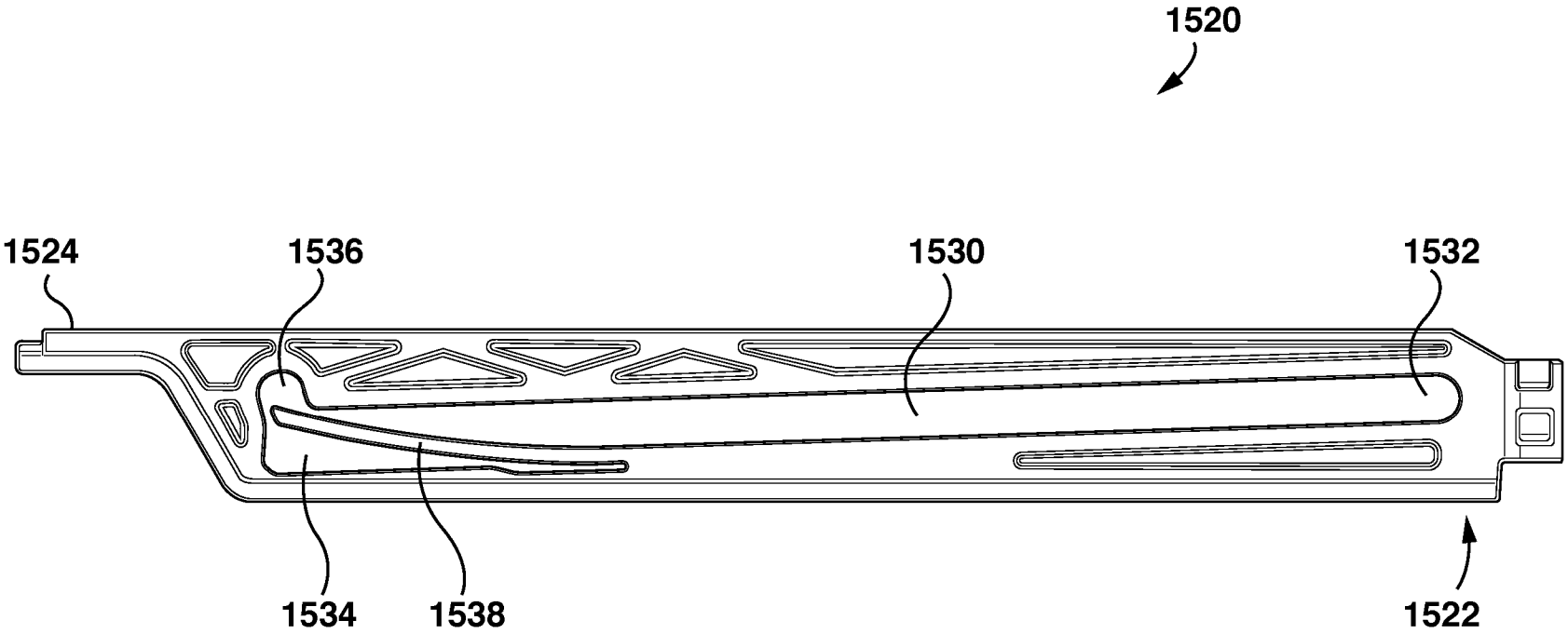
FIG. 9 is a plan view of a component of a locking mechanism of the apparatus of FIG. 1.
Figure 10A:
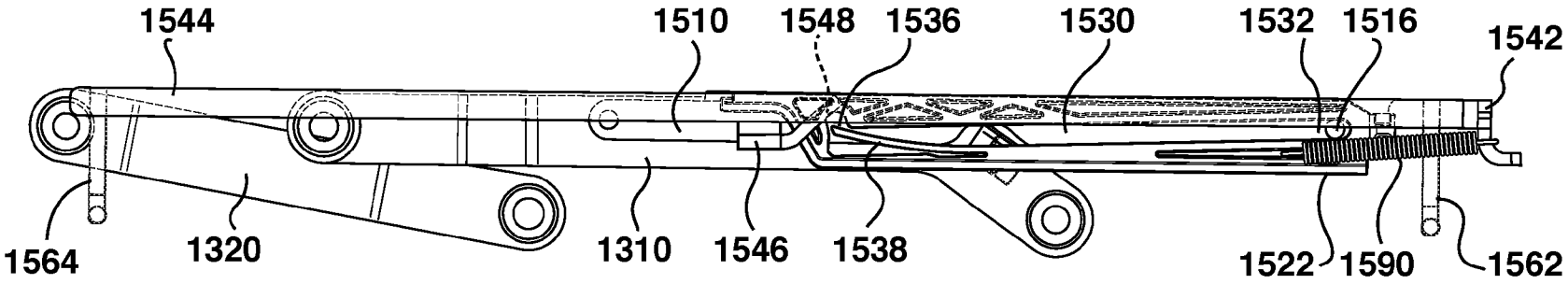
FIGS. 10A-E are a series of schematic plan views illustrating components of a locking mechanism as the apparatus of FIG. 1 as the apparatus is adjusted from the retracted position of FIG. 10A to the extended position of FIG. 10G.
Figure 10B:
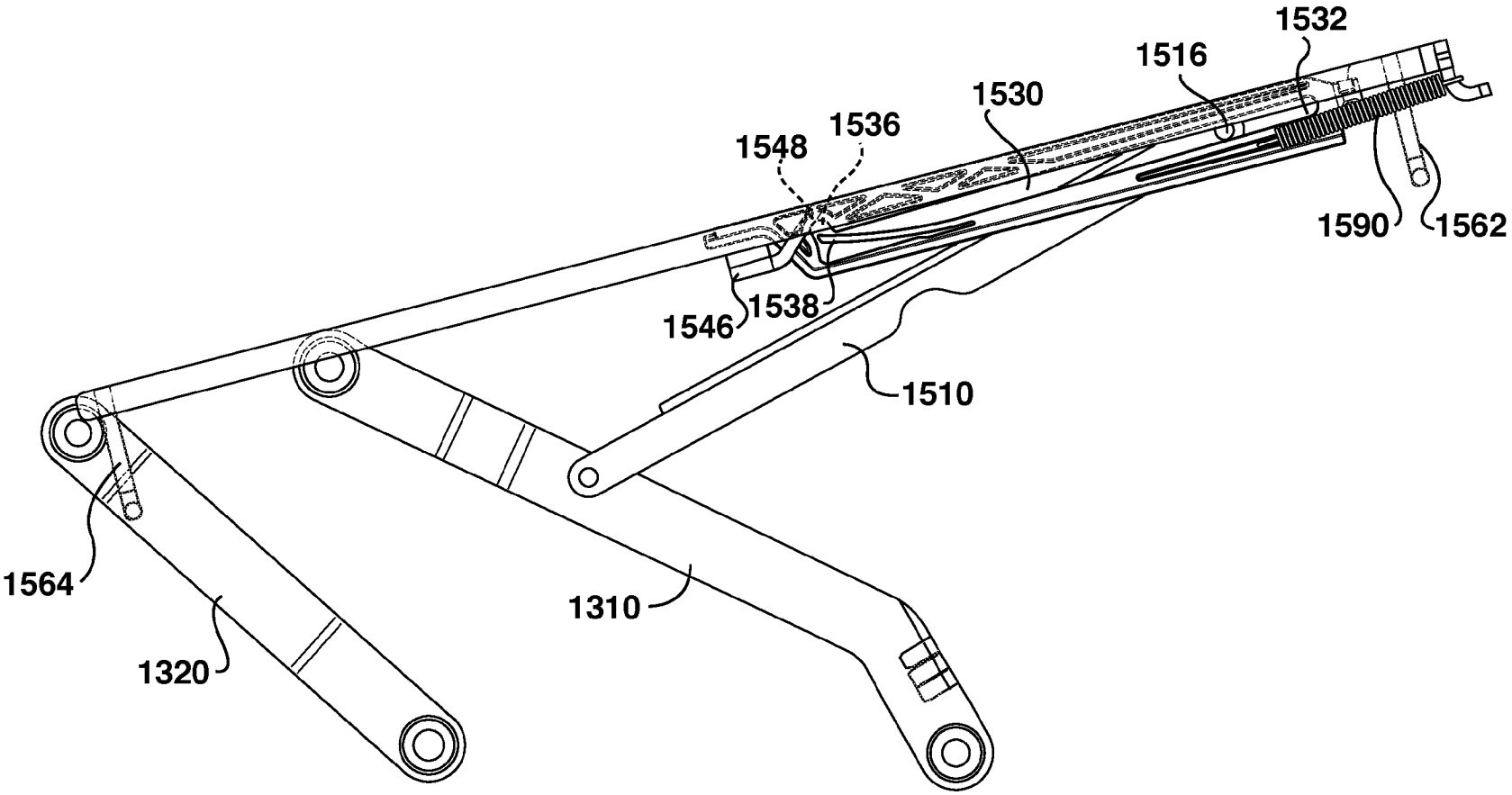
Figure 10C:
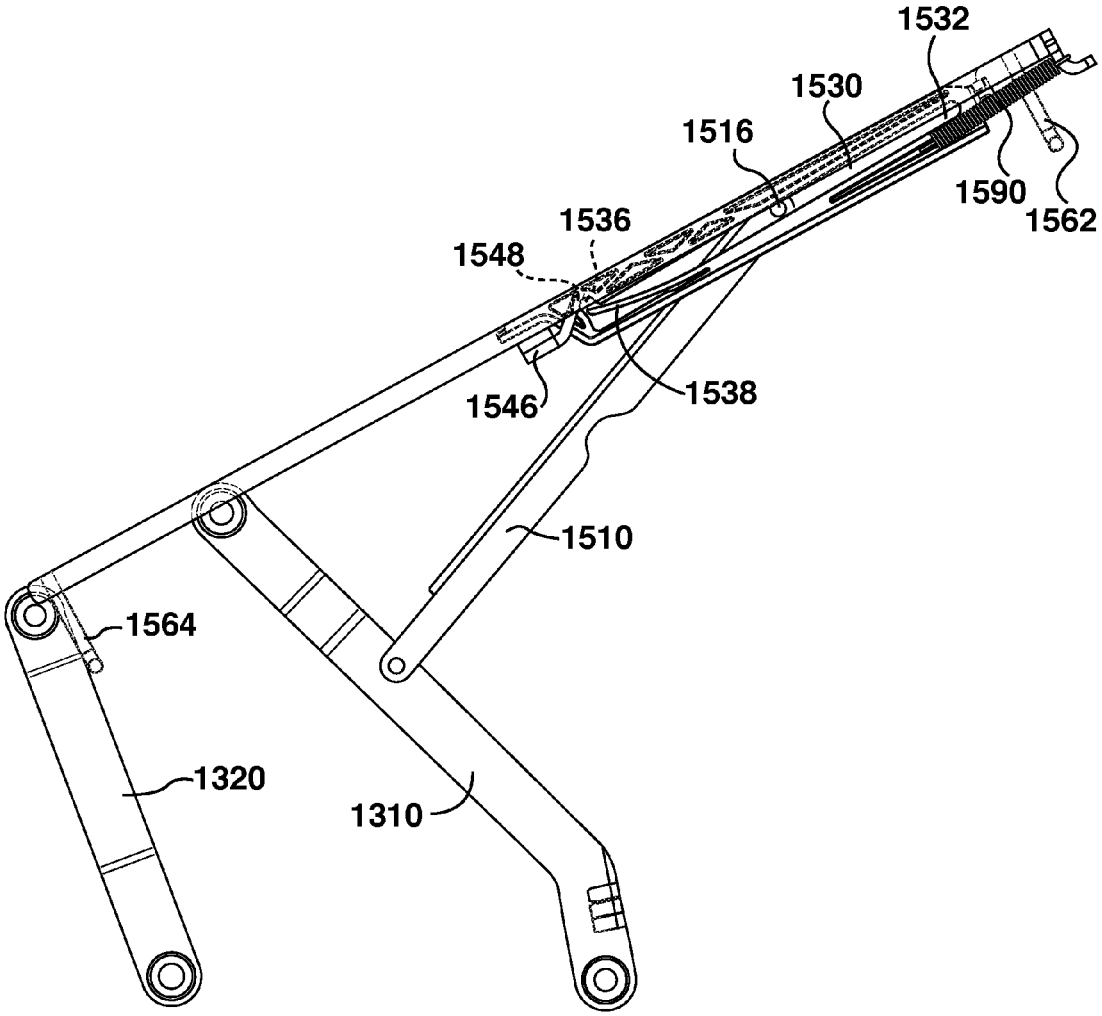
Figure 10D:
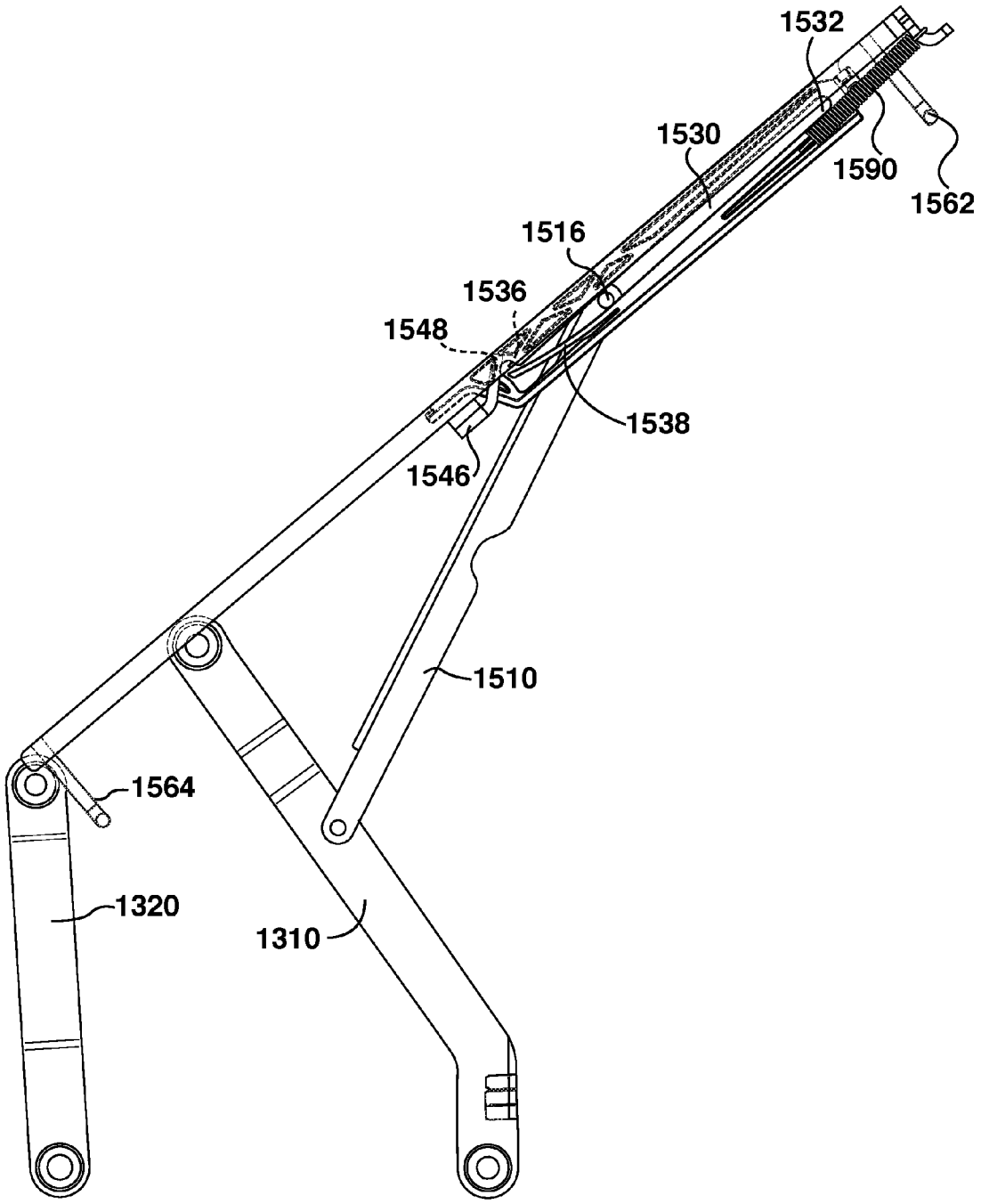
Figure 10E:
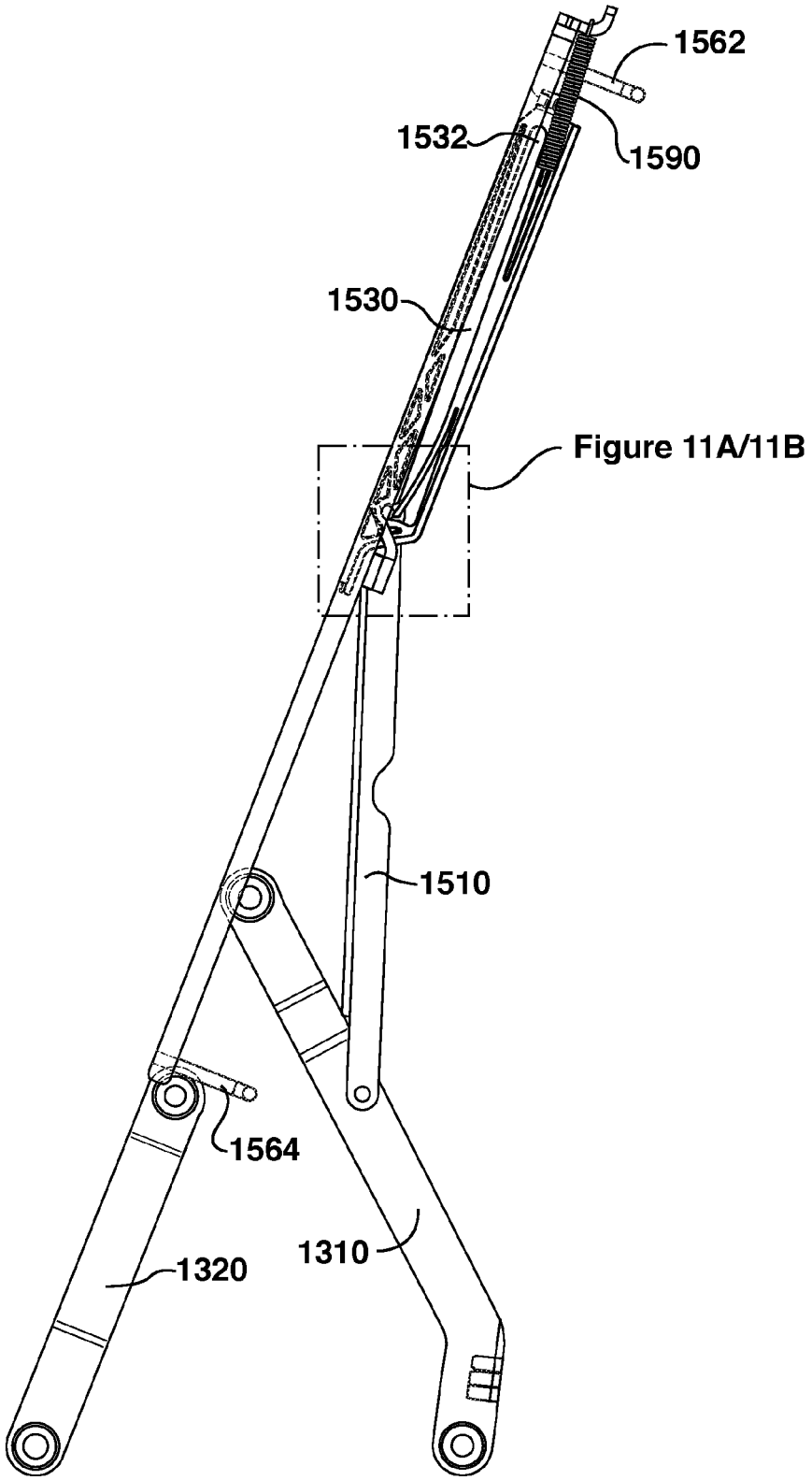

As shown in FIG. 9, lockout arm guide 1520 has a first end 1522 and a second end 1524. Lockout arm guide 1520 also defines a path 1530 for the guide protrusion 1516 of lockout arm 1510. Path 1530 extends between a first path end 1532 and a second path end 1534. Preferably, the central portion of the path 1530 and the second path end 1534 are substantially linear, but at a slight angle to the upper surface 1205 of upper end frame member 1200. Thus, path 1530 and guide protrusion 1516 cooperate to restrain the motion of the second end 1514 of lockout arm 1510 so that it travels substantially linearly, but at a slight angle to the upper surface 1205 of upper end frame member 1200.

The second end 1534 of the path 1530 is configured so that the guide protrusion 1516 can be releasably retained at the second end 1534. In the illustrated embodiment, the second end 1534 has a detent 1536 for releasably engaging guide protrusion 1516 when it is at the second end 1534 of the path. More specifically, when guide protrusion 1516 travels along path 1530 and reaches the second end 1534, guide protrusion 1516 engages detent 1536.

Preferably, an optional detent guide, such as resilient detent guide 1538, is provided in path 1530 to promote the engagement of guide protrusion 1516 and detent 1536 as guide protrusion 1516 approaches the second path end 1534.

As shown in FIGS. 10A to 10E, detent 1536 is configured so that when guide protrusion 1516 is engaged with detent 1536—e.g. when the upper and lower end frame members are in an extended position as shown in FIG. 4A—a force applied to urge upper end frame member 1200 towards lower end frame member 1100 does not urge the dislodgment of guide protrusion 1516 from detent 1536. Accordingly, in the extended position as shown in FIG. 4A, lockout arm 1510 prevents relative movement of the four-bar linkage of arms 1310, 1320 and upper and lower end frame members 1200, 1100.

Figure 11B:
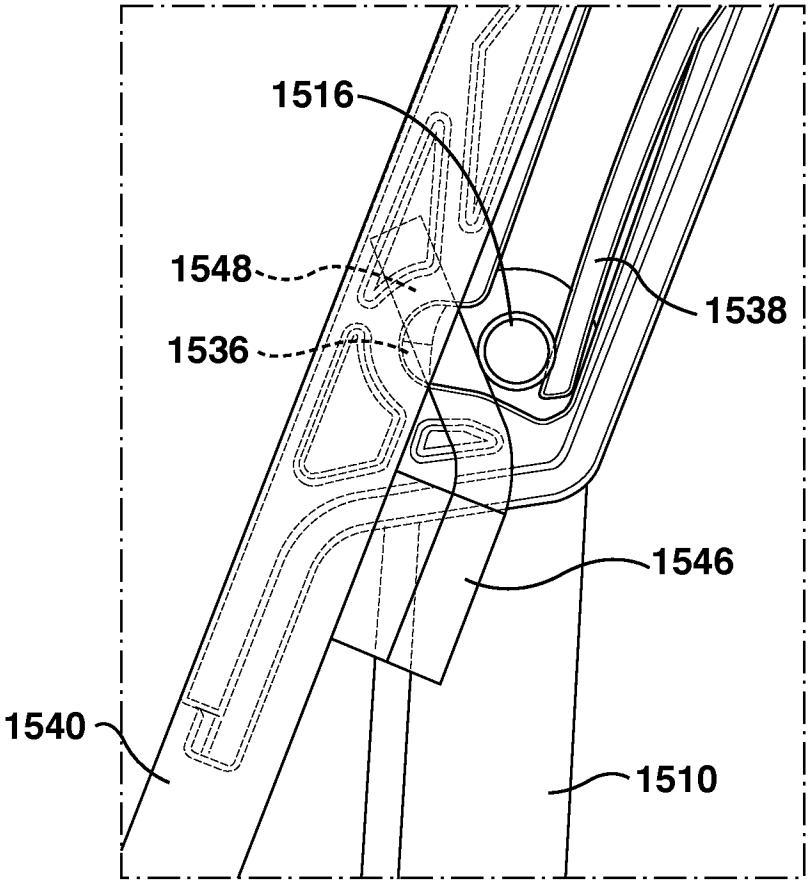
FIG. 11B is an enlarged view of box 11 in FIG. 10E with the locking mechanism in an unlocked configuration.
Figure 11A:
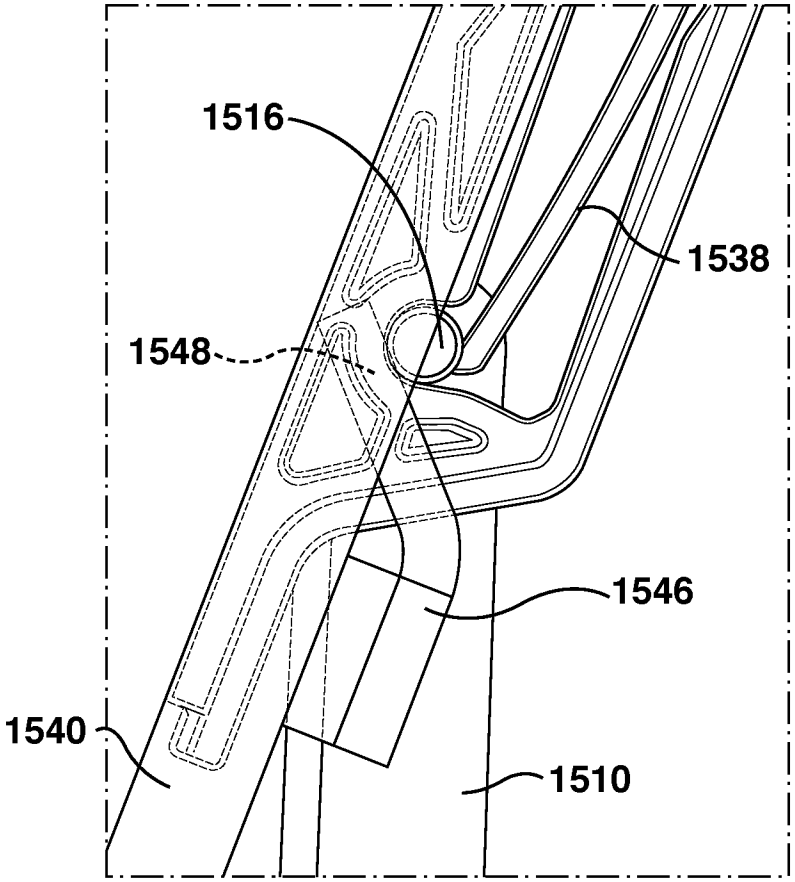
FIG. 11A is an enlarged view of box 11 in FIG. 10E with the locking mechanism in a locked configuration.

Turning to FIGS. 11A and 11B, to release the guide protrusion 1516 from the second end 1534 of the path 1530, e.g. from detent 1536, latching bar 1540 may be displaced (e.g. slid) longitudinally so that a strike plate or surface 1548 extending from a flange 1546 is brought into contact with guide protrusion 1516 and applies a force to guide protrusion 1516 to dislodge or otherwise release guide protrusion 1516 from detent 1536.

Latching bar 1540 is configured so that it can be displaced (e.g. slid) longitudinally to unlatch the upper and lower end frame members 1200, 1100 when they are in the retracted position, and to release lockout arm 1510 from restraining the upper and lower end frame members 1200, 1100 when they are in the extended position.

In the example illustrated in FIG. 6, latching bar 1540 is coupled to a pivotable release member 1700 positioned at the first end 1202 of upper end frame member 1200. In this arrangement, when the distal end of pivotable member 1700 is displaced away from the upper surface 1205 of upper end frame member 1200 (i.e. away from the underside of worksurface 120), latching bar 1540 is displaced (e.g. slid) longitudinally towards the first end 1202 of upper end frame member 1200.

In the illustrated example, a pivotable member 1700 is provided at the first end 1202 of both upper end frame members 1200, and the pivotable members are coupled to each other via a release bar 175 that extends between them. Accordingly, to release either the latching mechanism (e.g. to permit the worksurface to be adjusted from the level position towards the inclined position) or the lockout mechanism (e.g. to permit the worksurface to be adjusted from the inclined position towards the level position), a user simply pivots the release bar 175 away from the underside of worksurface 120.

While the illustrated example provides for a single release mechanism for both the latching mechanism and the lockout mechanism, it will be appreciated that separate release mechanisms may alternatively be provided. Also, while a pivotable release member 1700 is shown, alternative release systems may alternatively be used. For example, a translational member may be used, requiring a user to e.g. pull or slide release bar 175 away from the first ends 1202 of upper end frame members 1200 to displace latching bar 1540 longitudinally towards the first end 1202.

Figure 14A:
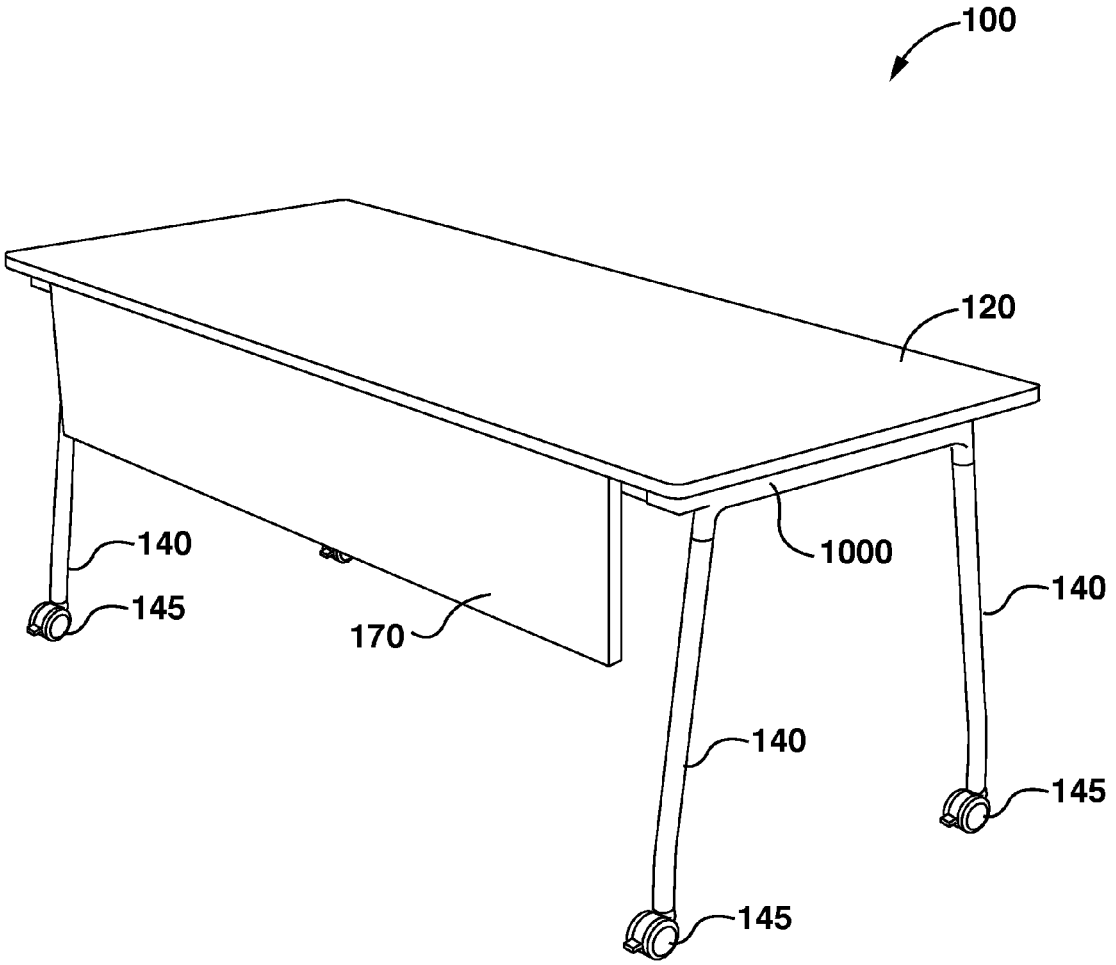
FIGS. 14A-C are a series of perspective views illustrating the worksurface of an alternative furniture piece being adjusted from the level position of FIG. 14A to the inclined position of FIG. 14C.
Figure 14B:
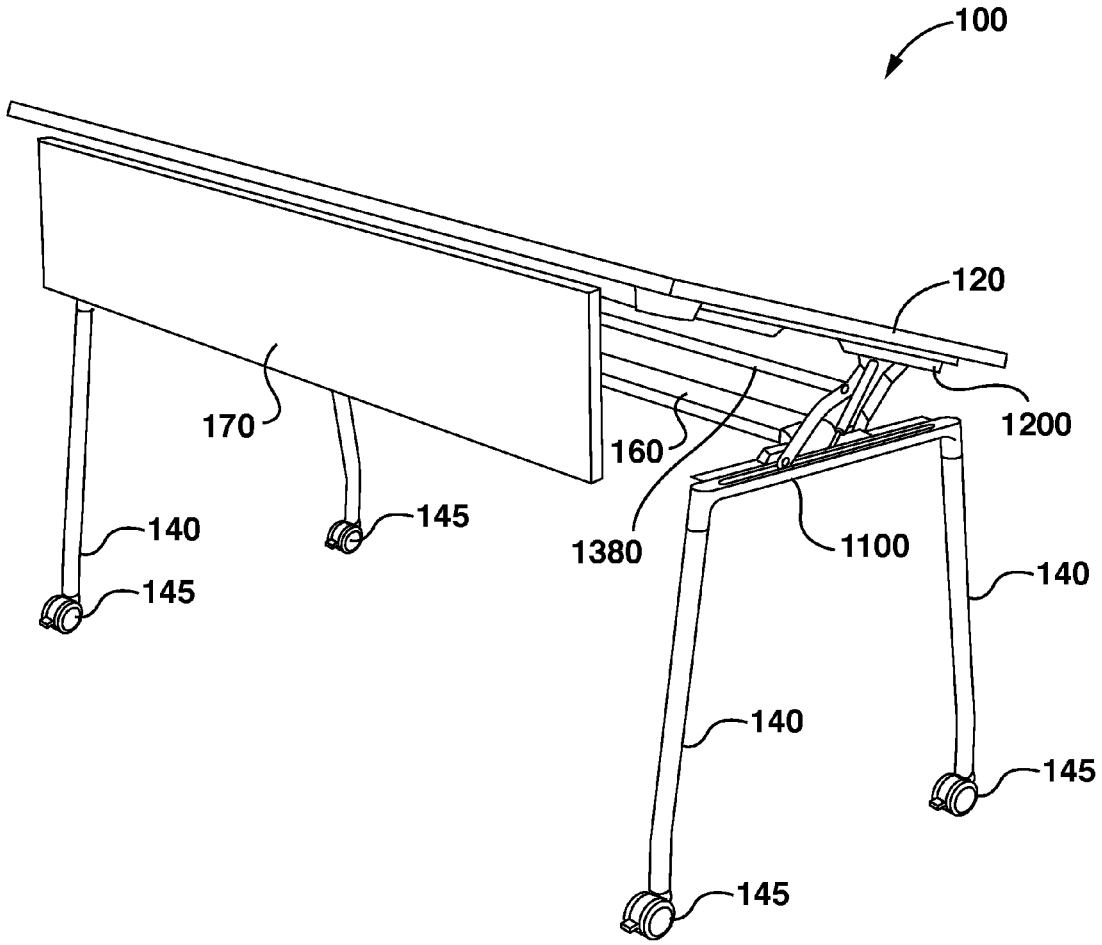
Figure 14C:
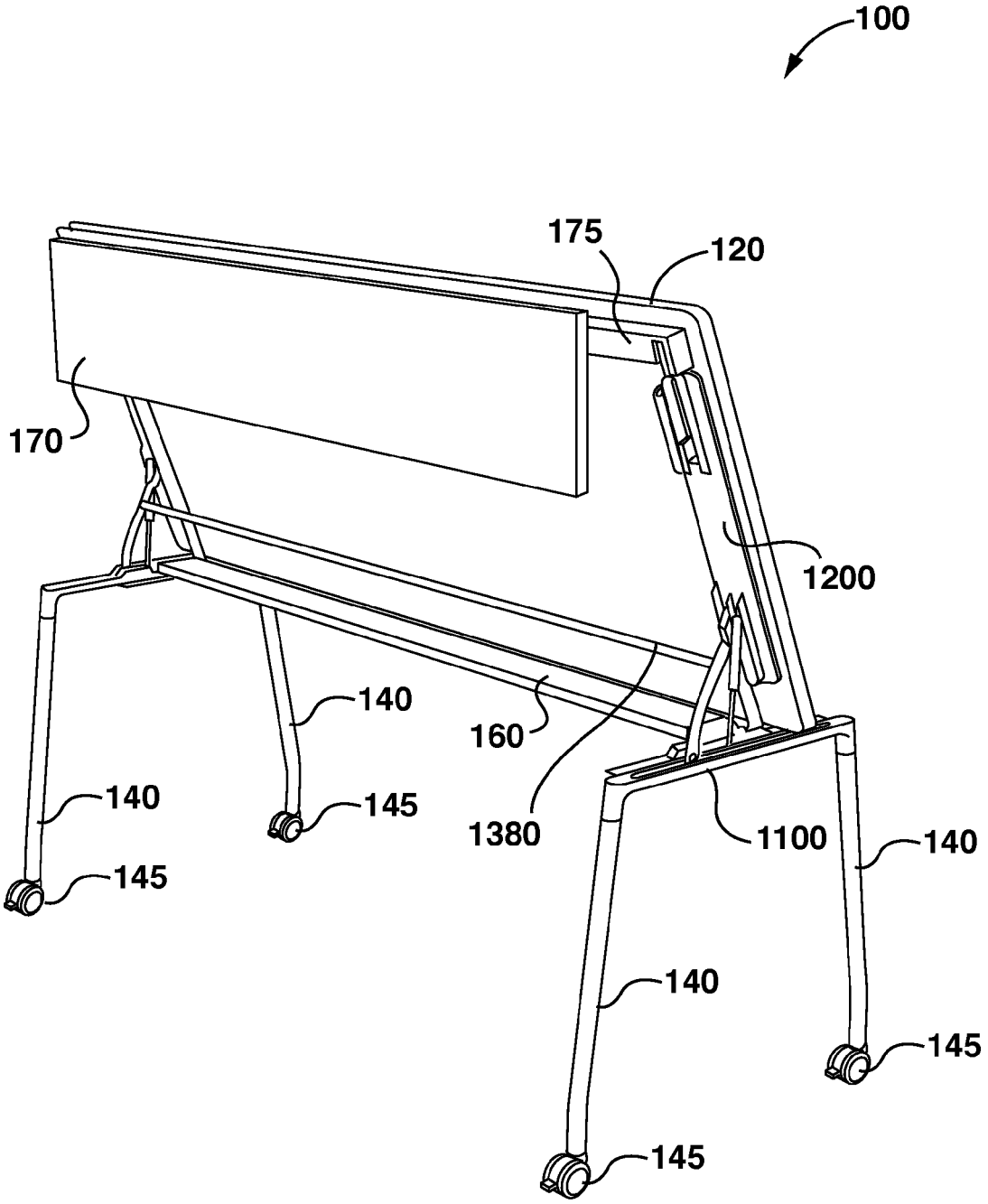

A variant embodiment of table 100 is shown in FIGS. 14A to 14C. As shown, casters 145 are provided at the lower ends of legs 140, which allows table 100 to be rolled across a floor surface. Any suitable caster or roller may be used, including locking casters.

FIGS. 14A to 14C also illustrate an optional modesty panel 170 that extends downwardly from worksurface 120 when the worksurface is in the level position shown in FIG. 14A. Modesty panel obscures at least a portion of the area under table 100 from view, and provides an alternative aesthetic appearance. Preferably, modesty panel 170 is rotationally coupled to worksurface 120, so that the modesty panel remains substantially vertical when worksurface 120 is adjusted to the inclined position shown in FIG. 14C. For example, modesty panel 170 may be rotationally coupled to release bar 175 using any suitable mechanism. Alternatively, a separate modesty panel support member may be secured to the underside of worksurface 120, and modesty panel 170 and modesty panel support member may be rotationally coupled to each other using any suitable mechanism.

Preferably, as seen in FIG. 14B, an optional linkage support member 1380 is secured to and extends between first arms 1310 of linkages 1300, to provide additional stability to and/or to assist in synchronizing the relative motion of linkages 1300.

Figure 15:
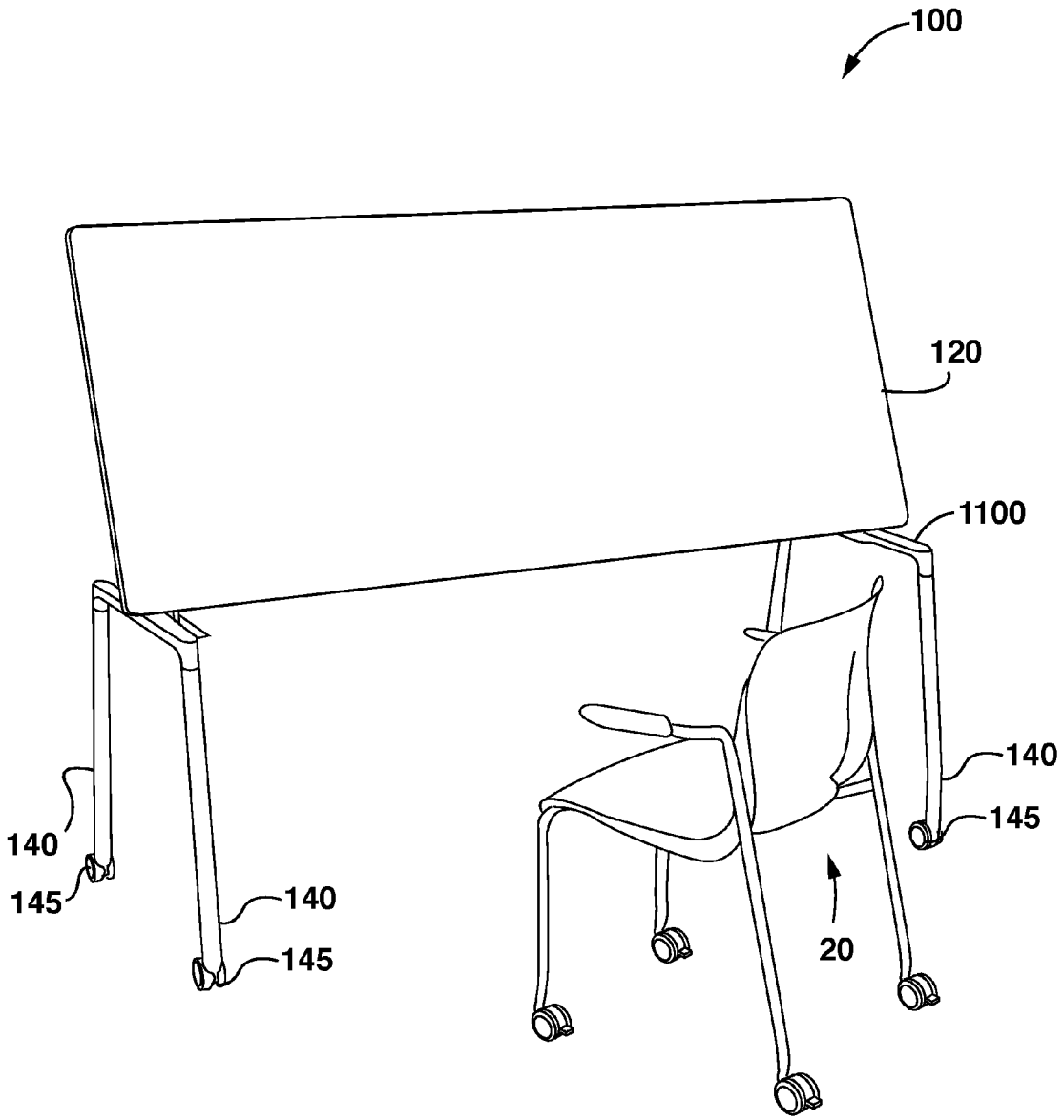
FIG. 15 is a perspective view of a furniture piece with a worksurface having a writable surface in an inclined position.

Optionally, as shown in FIG. 15, the upper surface of worksurface 120 may be provided with a writeable surface (such as, e.g. a whiteboard, blackboard, back painted glass, porcelain, etc.) so that, in the inclined position, worksurface 120 may be used as a display board.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A furniture piece comprising:

a worksurface;

a longitudinal frame member;

a pair of end frame mechanisms positioned at opposing ends of the longitudinal frame member, each end frame mechanism comprising:

a lower end frame member secured to the longitudinal frame member, an upper end frame member secured to a lower surface of the worksurface, and a linkage coupling the upper and lower end frame members, the linkage being configured to permit movement of the upper end frame member relative to the lower end frame member; and at least two legs extending downwardly from each lower end frame member for supporting the furniture piece;

wherein upper surfaces of the lower end frame members define a substantially horizontal plane, wherein the worksurface is configured to move between a first position wherein an upper surface of the worksurface is substantially horizontal and a second inclined position wherein the upper surface of the worksurface is located at an angle to the substantially horizontal plane, and wherein, in the second position, the entire worksurface is located above the substantially horizontal plane, and wherein at least one of the end frame mechanisms further comprises a latching system for restraining the worksurface in the first position, the latching system comprising:

a latching bar positioned in a latching bar recess of the upper end frame member, the latching bar having at least one latching protrusion that projects from a lower surface of the upper end frame member; and at least one latching recess provided in an upper surface of the lower end frame member, wherein, when the worksurface is in the first position, the at least one latching protrusion is received in the at least one latching recess;

wherein the latching bar is configured to move within the latching bar recess between:

a latched position in which, when the worksurface is in the first position, the at least one latching protrusion and the at least one latching recess cooperatively retain the worksurface in the first position, and an unlatched position.

2. The furniture piece of claim 1, wherein the linkage comprises, at each end frame mechanism, a first arm rotationally coupled to both the upper and lower end frame member, and a second arm rotationally coupled to both the upper and lower end frame member.

3. The furniture piece of claim 2, wherein the first arm is longer than the second arm.

4. The furniture piece of claim 2, further comprising a longitudinal support member extending between the first arms of the pair of end frame mechanisms.

5. The furniture piece of claim 2, wherein the linkage further comprises, at each end frame mechanism, a biasing member rotationally coupled to both the upper and lower end frame members, the biasing member being configured to extend and urge the worksurface towards the second position.

6. The furniture piece of claim 5, wherein the biasing member comprises a gas piston.

7. The furniture piece of claim 1, wherein, in the second position, the angle between the upper surface of the worksurface and the substantially horizontal plane is greater than 45 degrees.

8. The furniture piece of claim 7, wherein, in the second position, the angle between the upper surface of the worksurface and the substantially horizontal plane is about 70 degrees.

9. The furniture piece of claim 1, wherein the at least two legs extend downwardly from opposing ends of each lower end frame member.

10. The furniture piece of claim 1, wherein the entire upper surface of the worksurface remains above the substantially horizontal plane as the worksurface is moved between the first position and the second position.

11. The furniture piece of claim 3, wherein at least one of the end frame mechanisms further comprises a lockout system for restraining the worksurface in the second position, the lockout system comprising:

a lockout arm having a first end pivotably coupled to a central portion of the first arm and a second end having a guide protrusion; and a lockout arm guide positioned in the upper end frame member, the lockout arm guide defining a path for the guide protrusion between a first path end and a second path end, the second path end being configured such that the guide protrusion may be releasably retained at the second path end;

wherein, when the worksurface is in the second position and the guide protrusion is retained at the second path end, the lockout arm prevents the first arm from rotating relative to the upper end frame member.

12. The furniture piece of claim 11, further comprising a release bar configured to move the latching bar from the latched position to the unlatched position, and configured to release the guide protrusion from the second path end.

13. A furniture piece comprising:

a worksurface;

a support frame having a first end, a second end, and an upper surface, the upper surface defining a horizontal plane;

a linkage for coupling the support frame to the worksurface, wherein the linkage comprises a first arm rotationally coupled to both the support frame and the worksurface, and a second arm rotationally coupled to both the support frame and the worksurface, wherein the first arm is longer than the second arm;

wherein the linkage is configured to permit movement of the worksurface between a first position wherein the worksurface is substantially parallel to the horizontal plane and a second position wherein the worksurface is located at an angle to the horizontal plane; and a first pair of legs extending downwardly from the first end of the support frame and a second pair of legs extending downwardly from the second end of the support frame, wherein upper ends of the legs in each of the first and second pair of legs are spaced apart from each other by at least 300 mm, wherein the linkage further comprises a lockout system for restraining the worksurface in the second position, the lockout system comprising:

a lockout arm having a first end pivotally coupled to a central portion of the first arm and a second end having a guide protrusion; and a lockout arm guide positioned in an upper end frame member secured to the worksurface, the lockout arm guide defining a path for the guide protrusion between a first path end and a second path end, the second path end being configured such that the guide protrusion may be releasably retained at the second path end;

wherein, when the worksurface is in the second position and the guide protrusion is retained at the second path end, the lockout arm prevents the first arm from rotating relative to the upper end frame member, and wherein the furniture piece further comprises a latching system for restraining the worksurface in the first position, the latching system comprising:

a latching bar positioned in a latching bar recess of the upper end frame member, the latching bar having at least one latching protrusion that projects from a lower surface of the upper end frame member; and at least one latching recess provided in an upper surface of a lower end frame member, wherein, when the worksurface is in the first position, the at least one latching protrusion is received in the at least one latching recess;

wherein the latching bar is configured to move within the latching bar recess between:

a latched position in which, when the worksurface is in the first position, the at least one latching protrusion and the at least one latching recess cooperatively retain the worksurface in the first position, and an unlatched position.

14. The furniture piece of claim 13, wherein the linkage comprises two linkages, and further comprising a longitudinal support member that extends between the first arms of the linkage.

15. The furniture piece of claim 13, wherein the linkage further comprises a biasing member rotationally coupled to both the support frame and the worksurface, the biasing member being configured to extend and urge the worksurface towards the second position.

16. The furniture piece of claim 15, wherein the biasing member comprises a gas piston.

17. The furniture piece of claim 13, wherein, in the second position, the angle between the worksurface and the horizontal plane is greater than 45 degrees.

18. The furniture piece of claim 17, wherein, in the second position, the worksurface is entirely above the horizontal plane.

19. The furniture piece of claim 18, wherein the entire worksurface remains above the horizontal plane as the worksurface is moved between the first position and the second position.

20. The furniture piece of claim 13, wherein the upper ends of the legs in each of the first and second pair of legs are spaced apart from each other by at least 450 mm.

21. The furniture piece of claim 13, further comprising a release bar configured to move the latching bar from the latched position to the unlatched position, and configured to release the guide protrusion from the second path end.

* * * * *